US010237636B1

(12) United States Patent
Ivey

(10) Patent No.: US 10,237,636 B1
(45) Date of Patent: Mar. 19, 2019

(54) SMALL CEILING SPEAKER SYSTEM

(71) Applicant: Mitek Corp., Inc., Phoenix, AZ (US)

(72) Inventor: Johnathan Ivey, Chandler, AZ (US)

( * ) Notice: Subject to any disclaimer, the term of this patent is extended or adjusted under 35 U.S.C. 154(b) by 0 days.

(21) Appl. No.: 15/710,654

(22) Filed: Sep. 20, 2017

(51) Int. Cl.
*H04R 1/02* (2006.01)
*H04R 1/32* (2006.01)

(52) U.S. Cl.
CPC ..... *H04R 1/025* (2013.01); *H04R 1/026* (2013.01); *H04R 1/323* (2013.01); *H04R 2201/021* (2013.01)

(58) Field of Classification Search
CPC ..... H04R 1/02
See application file for complete search history.

(56) References Cited

U.S. PATENT DOCUMENTS 3,557,901 A * 1/1971 Young ..... H04R 1/345 181/176
3,816,672 A * 6/1974 Gefvert ..... H04R 1/26 181/144
4,923,032 A 5/1990 Nuernberger
5,311,409 A * 5/1994 King ..... G03B 15/06 362/17
5,590,210 A * 12/1996 Matsuo ..... H04R 9/025 29/594
5,673,329 A * 9/1997 Wiener ..... H04R 1/34 181/144
5,802,196 A * 9/1998 Nakamura ..... H04R 1/06 181/155
6,015,026 A * 1/2000 McGrath ..... B32B 5/26 181/286
6,122,386 A * 9/2000 Wiley ..... H04R 5/02 181/155
6,557,664 B1 * 5/2003 Andrews ..... H04R 1/30 181/152
7,606,379 B2 * 10/2009 Ivey ..... F21V 7/0008 381/160
8,573,356 B1 * 11/2013 Perdue ..... E04B 1/994 181/284
2002/0118853 A1 * 8/2002 Flentje ..... G10H 3/187 381/336
2004/0245042 A1 * 12/2004 Nevill ..... H04R 1/345 181/151
2007/0064958 A1 * 3/2007 Nakamura ..... H04R 1/345 381/71.1

(Continued)

*Primary Examiner* — Olisa Anwah
(74) *Attorney, Agent, or Firm* — Keith L. Jenkins, Registered Patent Attorney, LLC; Keith L. Jenkins

(57) ABSTRACT

A small dual-speaker ceiling speaker system including a loudspeaker and a tweeter with an acoustic diffuser that is adjustable over a range of lengths for different thicknesses of ceiling tile and is independently adjustable over a range of acoustic port sizes. The loudspeaker sends acoustic waves into a acoustic channel that includes a truncated conical shell, or acoustic channel cone, with a cylindrical acoustic channel shell extending therefrom. A tweeter is mounted in the acoustic channel shell. A diffuser couples to the acoustic channel shell using threads that may be engaged or disengaged. The diffuser has a diffuser element that can be raised or lowered with a screw to adjust the size of the acoustic port. The diffuser element has demarcations for visually indicating acoustic port size. A housing with a base having extendable braces supports the speaker system on the ceiling grid, rather than on the tile.

19 Claims, 20 Drawing Sheets

(56) References Cited

U.S. PATENT DOCUMENTS

| | | | | |
|---|---|---|---|---|
| 2007/0131477 | A1* | 6/2007 | Combest | H04R 1/02 181/150 |
| 2007/0199766 | A1* | 8/2007 | Iwayama | H04R 1/345 181/144 |
| 2009/0028372 | A1* | 1/2009 | Cerasuolo | F21V 33/0052 381/387 |
| 2009/0183942 | A1* | 7/2009 | Hawkins | G10K 11/20 181/175 |
| 2010/0272301 | A1* | 10/2010 | Skramstad | H04R 1/30 381/345 |
| 2012/0014551 | A1* | 1/2012 | Ohashi | G10K 11/20 381/333 |
| 2012/0170782 | A1* | 7/2012 | Ettinger | H04R 1/028 381/332 |
| 2013/0251181 | A1* | 9/2013 | Stewart, Jr. | H04R 1/025 381/332 |
| 2017/0078810 | A1* | 3/2017 | Lee | H04R 27/00 |
| 2017/0332166 | A1* | 11/2017 | Kikuchi | H04R 1/24 |

* cited by examiner

SMALL CEILING SPEAKER SYSTEM

FIELD OF ART

The present invention relates to ceiling mounted loudspeakers having a small form factor and good sound dispersion. The present invention more particularly relates to a small speaker system with a sound diffuser that can adjust over a range of thicknesses of ceiling tiles and over a range of acoustic port sizes.

BACKGROUND OF THE INVENTION

Ceiling speakers are used in suspended ceilings, typically for public address, alarm, or musical entertainment purposes. Conventional ceiling speakers are designed for predetermined thicknesses of ceiling tile. Conventional ceiling speakers have fixed acoustic port sizes. Conventional ceiling speakers also load the ceiling tile which can cause deformation or failure of the tile over time.

SUMMARY OF THE INVENTION

Briefly described, the invention includes a small ceiling speaker with a variable adjustable length sound diffuser that is adjustable over a range of ceiling tile thicknesses. The variable length sound diffuser also has an independently adjustably sized acoustic port. The portion of the small ceiling speaker that is above the ceiling tile is preferably supported in an enclosure that is supported directly by the grid of tile supports, and not on the tiles per se. The portion of the small ceiling speaker that is below the ceiling tile is small and operable to manually change the size of the acoustic diffusion port. The sound diffuser has radially extending grooves on the diffusing element surface that receive radial supports from the diffuser barrel. The sound diffuser has demarcations on the diffusing element surface to enable an installer or operator to gauge the size of the diffusion port.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

Figure 10:
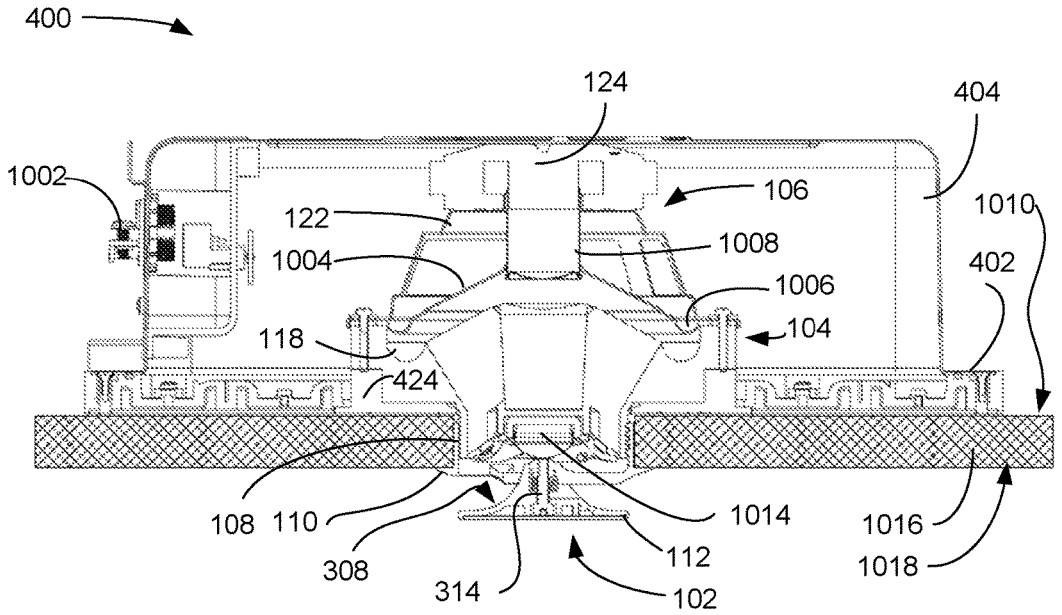
FIG. 10 is a cross sectional elevation view illustrating the exemplary embodiment of the small ceiling speaker system of FIG. 1 and FIG. 4 in a contracted position, according to a preferred embodiment of the present invention.

As used and defined herein, "top", "bottom", "upper", "lower", "upward", and "downward" are referenced to the present invention in its installed orientation, as illustrated in FIG. 10. As used and defined herein, "speaker" means "loudspeaker" or "tweeter", as shown in FIG. 10. As used and defined herein, "diffuser", without more, means an acoustic diffuser for diffusing sound.

Figure 1:
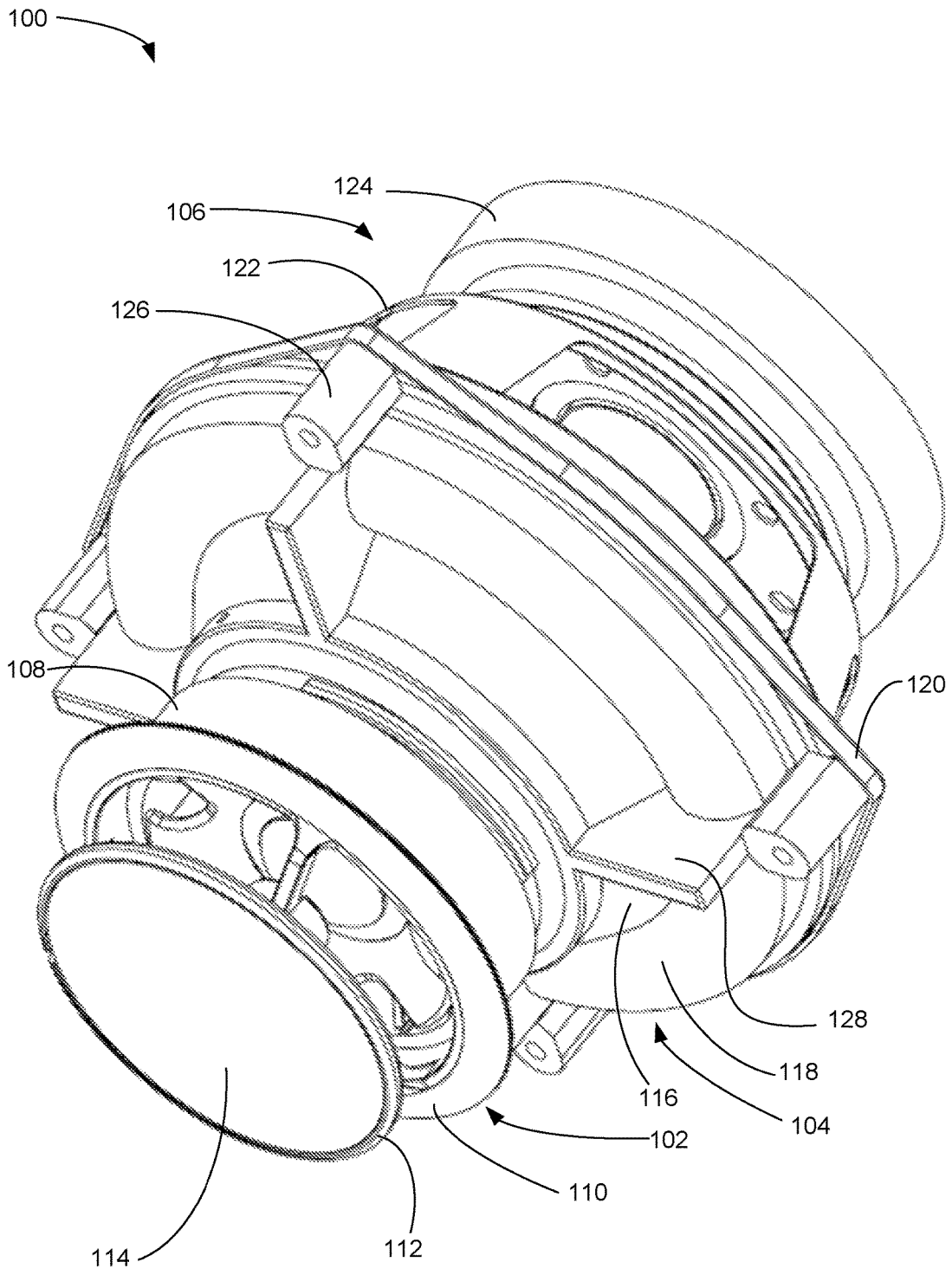
FIG. 1 is a side-bottom perspective view illustrating an exemplary embodiment of the small ceiling speaker system, according to a preferred embodiment of the present invention.

FIG. 1 is a side-bottom perspective view illustrating an exemplary embodiment of the small ceiling speaker system 100, according to a preferred embodiment of the present invention. Small ceiling speaker system 100 includes a speaker 106, an acoustic channel 104, and a diffuser 102 that is adjustable in two ways. Speaker 106 includes magnet 124, basket 122 supporting magnet 124, basket rim 120, support fittings 126 (one of four labeled) and surround accommodator 118, which will be discussed in more detail below. Speaker 106 directs sound downward when in an installed orientation. Acoustic channel 104 includes acoustic channel cone 116 and acoustic channel shell 502 (see FIG. 5) and will be discussed in more detail below. Acoustic channel cone 116 is a truncated conical shell extending from the speaker 106. Acoustic channel shell 502 (see FIG. 5) is a cylindrical shell that is of one piece with acoustic channel cone 116. Adjustable diffuser 102 includes diffuser barrel 108, flange 110, diffuser rim 112, and cover plate 114 and will be discussed in more detail below. When installed in a ceiling, exterior portions of the small ceiling speaker system 100 between flange 110 and cover plate 114 are visible below a ceiling tile 1016 (see FIG. 10), while the remainder of the small ceiling speaker system 100 is not.

Figure 2:
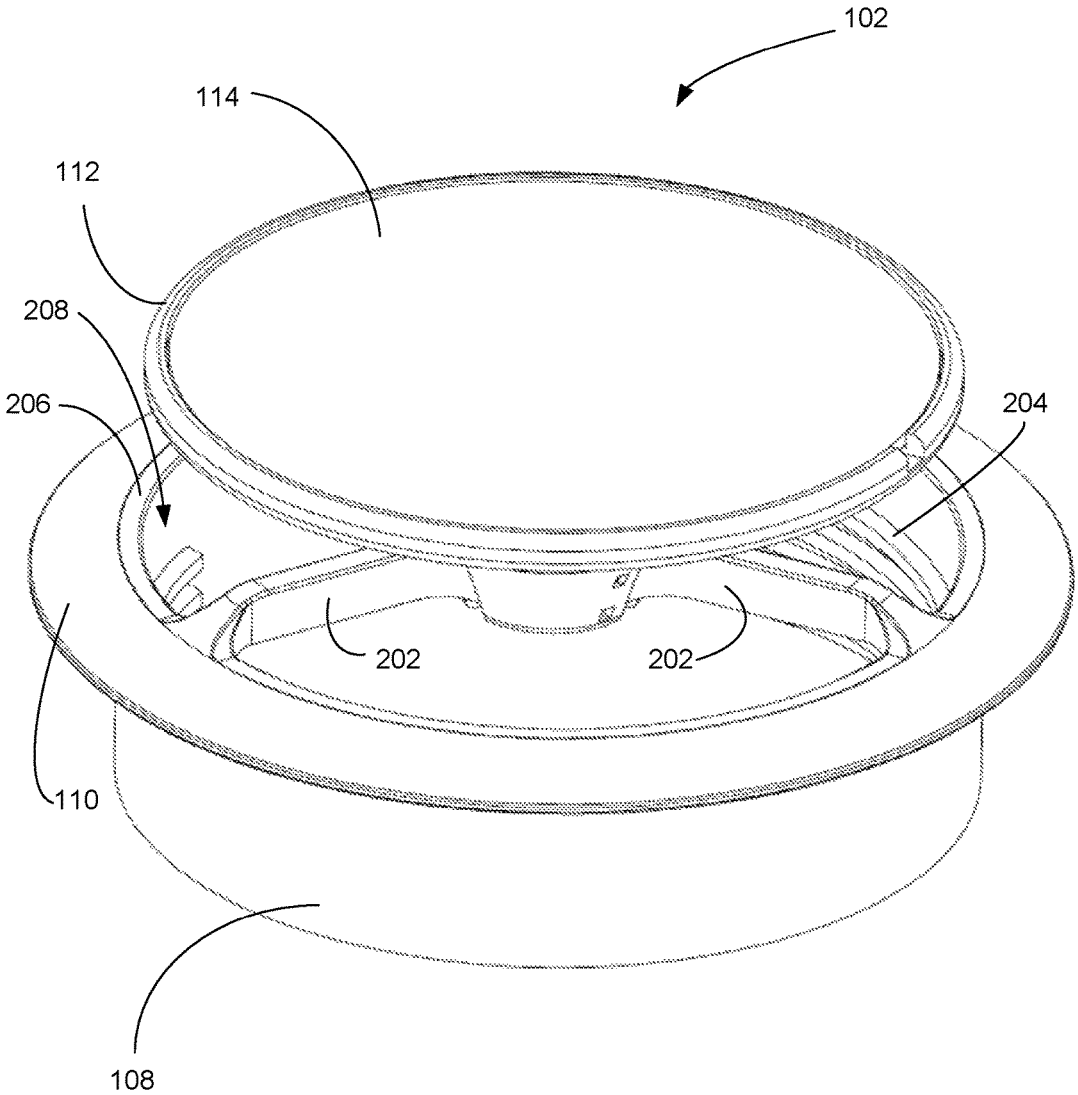
FIG. 2 is a bottom perspective view illustrating an exemplary embodiment of a diffuser of the small ceiling speaker system of FIG. 1, according to a preferred embodiment of the present invention.

FIG. 2 is a bottom perspective view illustrating an exemplary embodiment of a diffuser 102 of the small ceiling speaker system 100 of FIG. 1, according to a preferred embodiment of the present invention. Flange 110 has an inner radially downward sloping portion 206 from which three diffuser element supports 202 (two visible in this view) extend radially inwardly. The interior surface 208 of diffuser barrel 108 has partial diffuser threads 204 for adjusting the distance between the flange 110 and the bottom of the acoustic channel cone 116, to adapt to different thicknesses of ceiling tile 1016, 1102 (see FIG. 10 and FIG. 11). Cover plate 114 fits inside diffuser rim 112.

Figure 3:
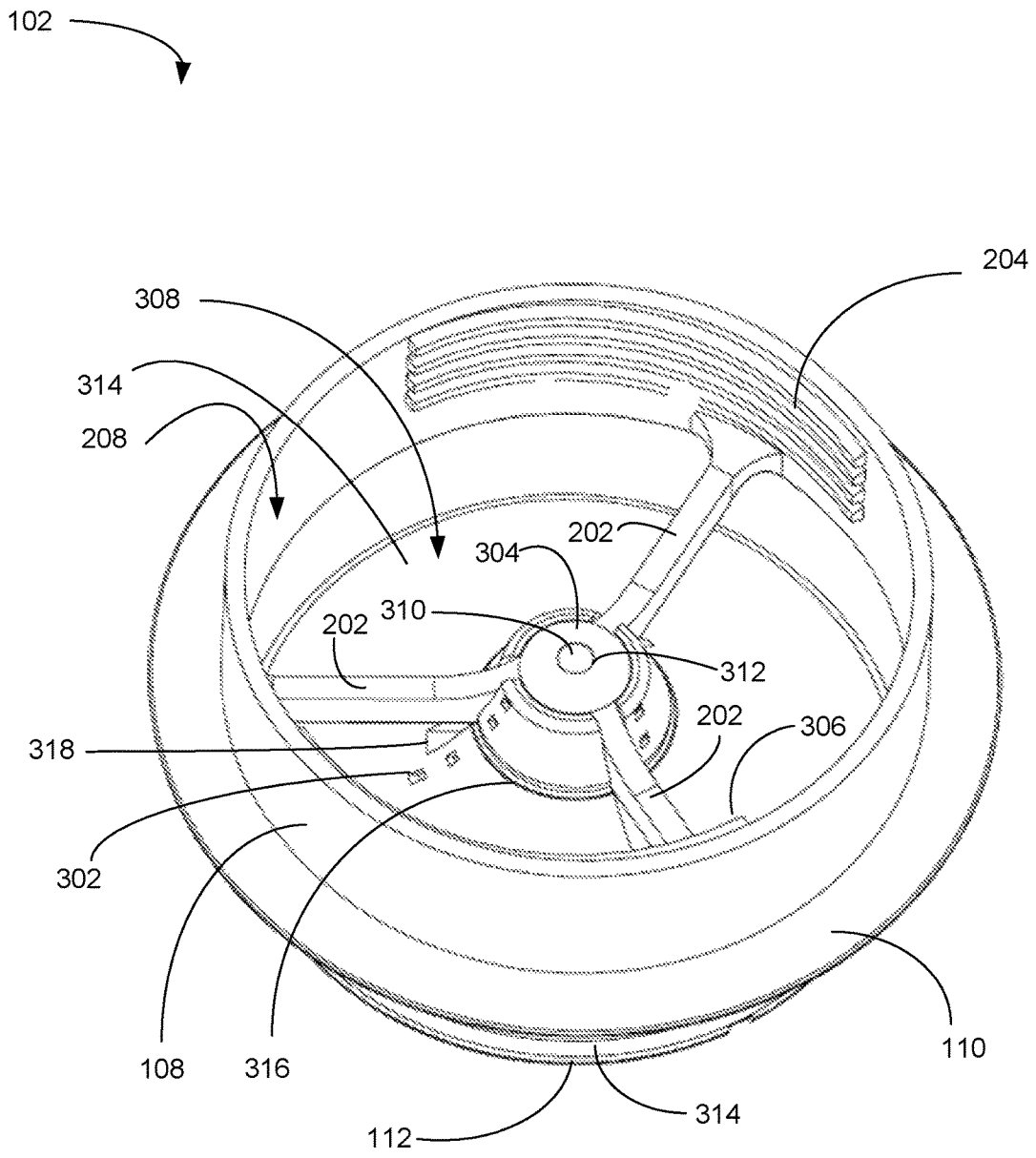
FIG. 3 is a top perspective view illustrating the exemplary embodiment of the diffuser of the small ceiling speaker system of FIG. 1, according to a preferred embodiment of the present invention.

FIG. 3 is a top perspective view illustrating the exemplary embodiment of the diffuser 102 of the small ceiling speaker system 100 of FIG. 1, according to a preferred embodiment of the present invention. Diffuser 102 includes diffuser barrel 108, with flange 110, diffuser element supports 202, hub 304, and diffuser element 314 with radially symmetric outwardly descending diffuser upper surface 308, demarcations 302, and special demarcation 316. Sets of diffuser threads 204 and 306 are on opposite sides of the interior surface 208 of diffuser barrel 108 and each extends no more than ninety degrees around of the interior surface 208 of diffuser barrel 108. Diffuser threads 204 and 306 enable adjustment over a range of ceiling tile 1016, 1102 (see FIG. 10 and FIG. 11) thicknesses. The three diffuser element supports 202 are preferably of one piece with hub 304. A screw end 310 of fastener 1502 (see FIG. 16) can be seen in threaded bore 312 of hub 304. Hub 304 has internal threads complimentary to the threads on fastener 1502. Inner portions of the three diffuser element supports 202 are not affixed to radially symmetric outwardly descending diffuser upper surface 308. Demarcations 302 (one labeled of multiple on radially symmetric outwardly descending diffuser upper surface 308 give a visual indication, for the installer or operator, of the size of the diffuser acoustic port 1902 (see FIG. 19) ranging upward to diffuser acoustic port 2002 (see FIG. 20). Special demarcation 316 is a semi-circumferential groove on radially symmetric outwardly descending diffuser upper surface 308 to indicate the optimal adjustment level for this small ceiling speaker system 100. In various other embodiments, other means of making special demarcation 316, such as printing, embossing, painting, or laminating may be used. Grooves 318 (one of three labeled) receive the diffuser element supports 202 to varying extents, depending on the adjusted size of the diffuser acoustic port 1902 (see FIG. 19) or 2002 (see FIG. 20). The advantage is that many small ceiling speaker systems 100 in one large room can be adjusted to be all the same or be adjusted adaptively to an acoustical design using fastener 1502 (see FIG. 16) and the demarcations 302. The diffuser acoustic port 1902 (see FIG. 19) or 2002 (see FIG. 20) are acoustical ports. The small ceiling speaker system 100 has a first adjustment over a range of thicknesses of the ceiling tiles (such as 1102 in FIG. 11) and a second adjustment over a range of sizes of the diffuser acoustic port (such as 2002 in FIG. 20).

Figure 4:
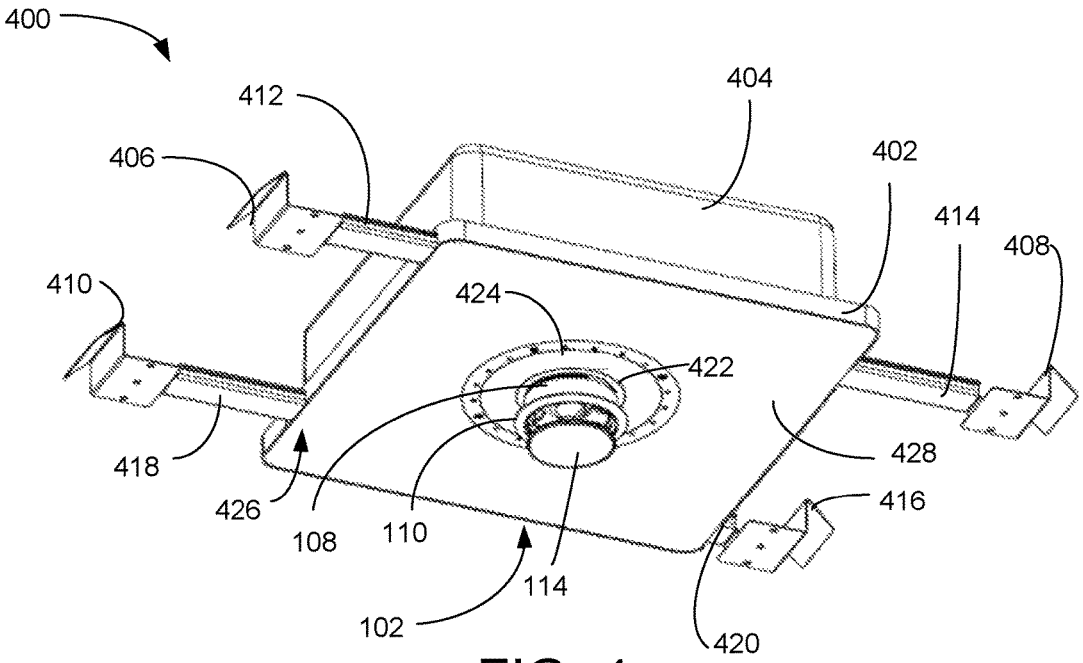
FIG. 4 is a bottom perspective view illustrating the exemplary embodiment of the diffuser of the small ceiling speaker system of FIG. 1 in a contracted position, according to a preferred embodiment of the present invention.

FIG. 4 is a bottom perspective view illustrating the exemplary embodiment of the diffuser 102 of the small ceiling speaker system 100 of FIG. 1 in a contracted position, according to a preferred embodiment of the present invention. Diffuser barrel 108 protrudes through opening 422 in carrier 424 in base 402 of speaker enclosure 404.

The distance between flange 110 and the bottom surface 426 of base 402 is at a minimum for the illustrated embodiment, representing an adaptation to a relatively thin ceiling tile 1016 (see FIG. 10). Base 402 and enclosure 404 form small ceiling speaker system 400. Braces 406, 408, 410, and 416 are supported on extendable rails 412, 414, 418, and 420, respectively, and are configured to rest on ceiling grid members of a suspended ceiling. The advantage is that the weight of the small ceiling speaker system 100 and the enclosure 404 does not rest on the tile itself, but are supported entirely on the grid. Extendable rails 412, 414, 418, and 420 are shown at variable extents to illustrate extendibility. In practice, the rails 412, 414, 418, and 420 on each side are usually extended to equal lengths. Extendable rails 412, 414, 418, and 420 are frictionally maintained at length with the help of a steel reed spring 2204 in each respective track 2210, 2226, 2206, and 2208 (see FIG. 22) in which slides each rail 412, 414, 418, and 420, respectively. In various embodiments, reed spring 2204 may be made of other materials of equivalent strength and resiliency, such as alloys, plastics, and composites. Bottom panel 428 of base 402 has a bottom surface 426 and a central opening 2220 (see FIG. 22), which will be discussed further below.

Figure 5:
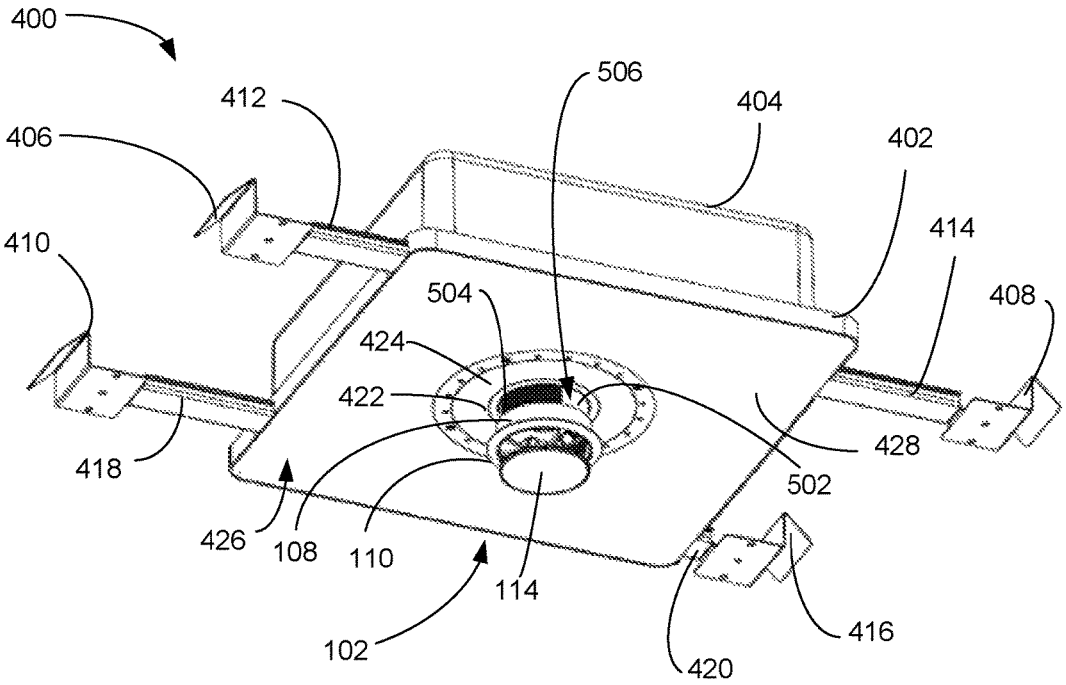
FIG. 5 is a bottom perspective view illustrating the exemplary embodiment of the diffuser of the small ceiling speaker system of FIG. 1 in an extended position, according to a preferred embodiment of the present invention.

FIG. 5 is a bottom perspective view illustrating the exemplary embodiment of the diffuser 102 of the small ceiling speaker system 100 of FIG. 1 in an extended position, according to a preferred embodiment of the present invention. Acoustic channel shell 502 extends from acoustic channel cone 116. Shell threads 504 extend no more than ninety degrees around acoustic channel shell 502 and include a second set of similar threads one hundred and eighty degrees from the shell threads 504 shown. Unthreaded portions of the shell surface 506 space apart first and second sets of shell threads 504. The diffuser threads 204, 306 within the diffuser 102 may engage or disengage shell threads 504 on acoustic channel shell 502, depending on the angle of rotation of diffuser 102. When diffuser threads 204, 306 align to unthreaded portions of the shell surface 506 between shell threads 504, the threads disengage. Height adjustment of the diffuser 102 is done by rotating the flange 110 to disengage diffuser threads 204, 306 from shell threads 504, sliding the diffuser 102 up and down to position the flange 110 flush with the bottom surface 1018 of ceiling tile 1016 (see FIG. 10), then rotating the diffuser 102 to re-engage the diffuser threads 203, 306 with shell threads 504. The distance between flange 110 and the bottom surface 426 of base 402 is at a maximum for the illustrated embodiment, representing an adaptation to a relatively thick ceiling tile 1102 (see FIG. 11).

Figure 6:
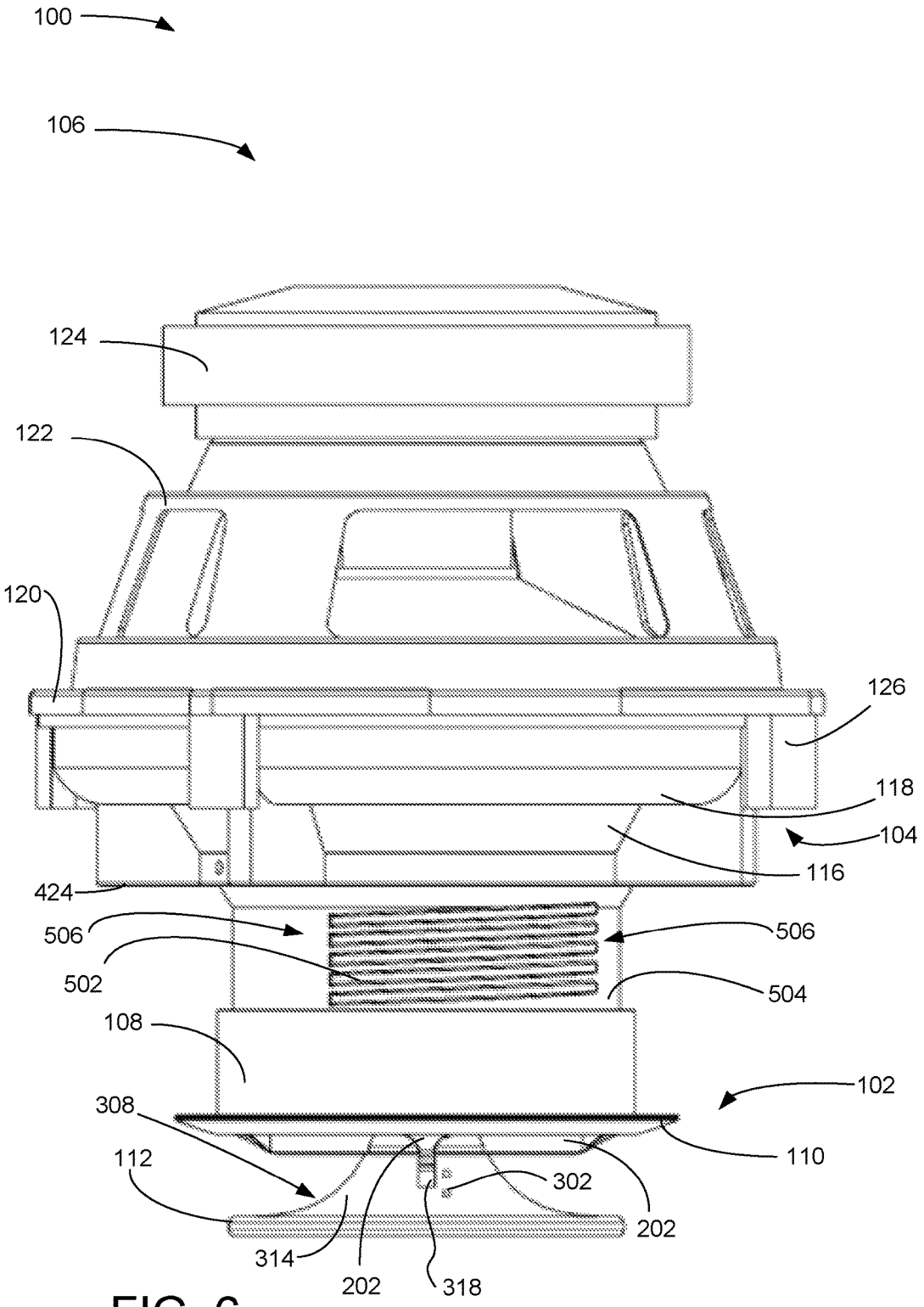
FIG. 6 is a side elevation view illustrating the exemplary embodiment of the diffuser of the small ceiling speaker system of FIG. 1 with the diffuser in an extended position, according to a preferred embodiment of the present invention.

FIG. 6 is a side elevation view illustrating the exemplary embodiment of the diffuser 102 of the small ceiling speaker system 100 of FIG. 1 with the diffuser 102 in an extended position, according to a preferred embodiment of the present invention. While the diffuser 102 is adjusted for a thick ceiling tile 1102 (see FIG. 11), the diffuser acoustic port 1902 (see FIG. 19) is at an intermediate size, as shown by the relationship of diffuser element support 202 with the bottom of groove 318 in diffuser element 314. The isolation of shell threads 504 between unthreaded portions of the shell surface 506 can be clearly seen.

Figure 7:
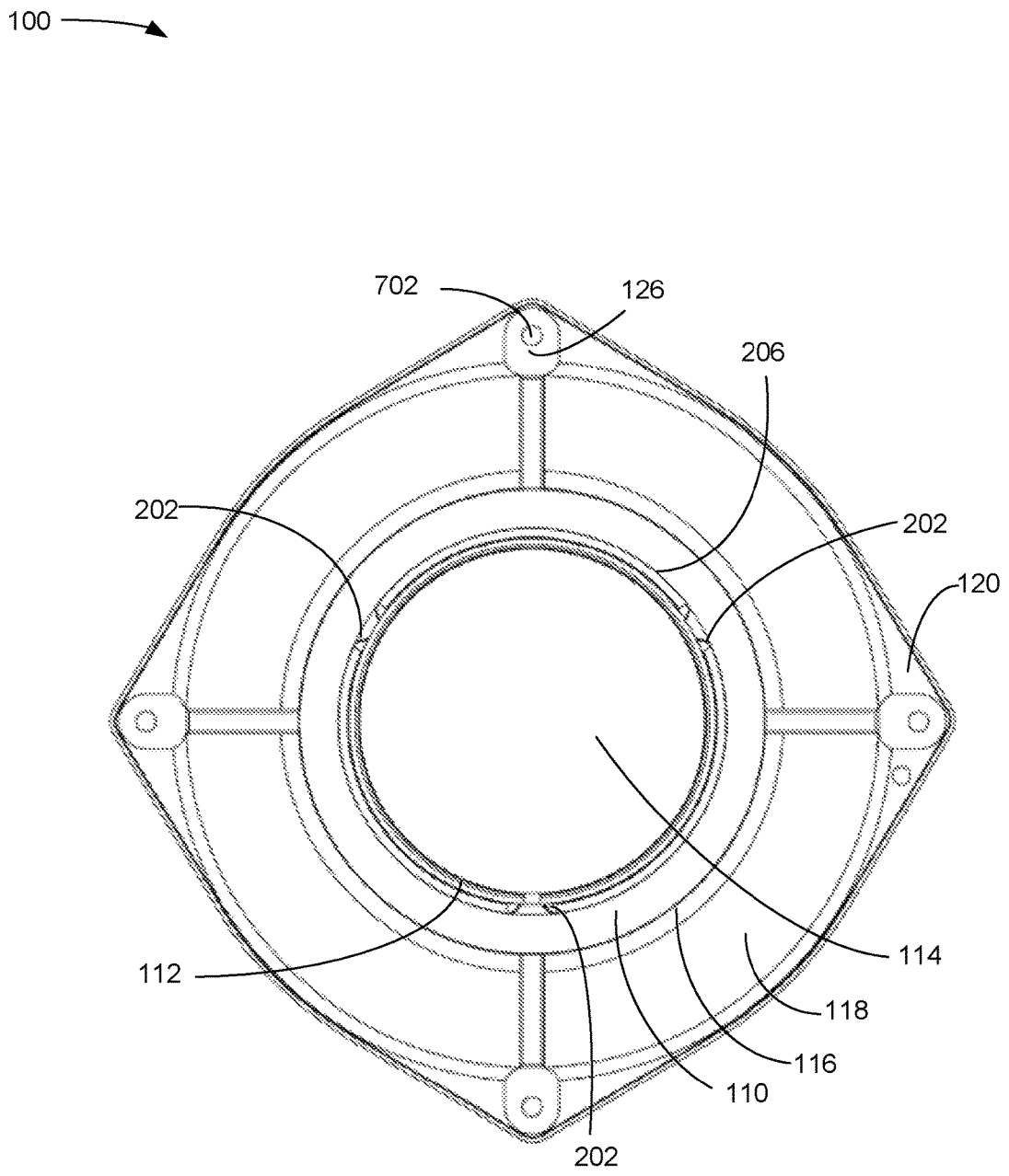
FIG. 7 is a bottom plan view illustrating the exemplary embodiment of the small ceiling speaker system of FIG. 1 in an extended position, according to a preferred embodiment of the present invention.

FIG. 7 is a bottom plan view illustrating the exemplary embodiment of the small ceiling speaker system 100 of FIG. 1, according to a preferred embodiment of the present invention. Cover plate 114 is preferably a material that is attracted to magnets. In some embodiments cover plate 114 may be adhered by non-magnetic means, be translucent, and/or have one or more light sources behind it for signaling, such as for alarms, alerts, etc. Cover plate 114 may bear a logo or design, or be colored and designed to blend in with the texture and color of a ceiling tile. Support fitting 126 (one of four labeled) have respective fastener bores 702 (one of four labeled).

Figure 8:
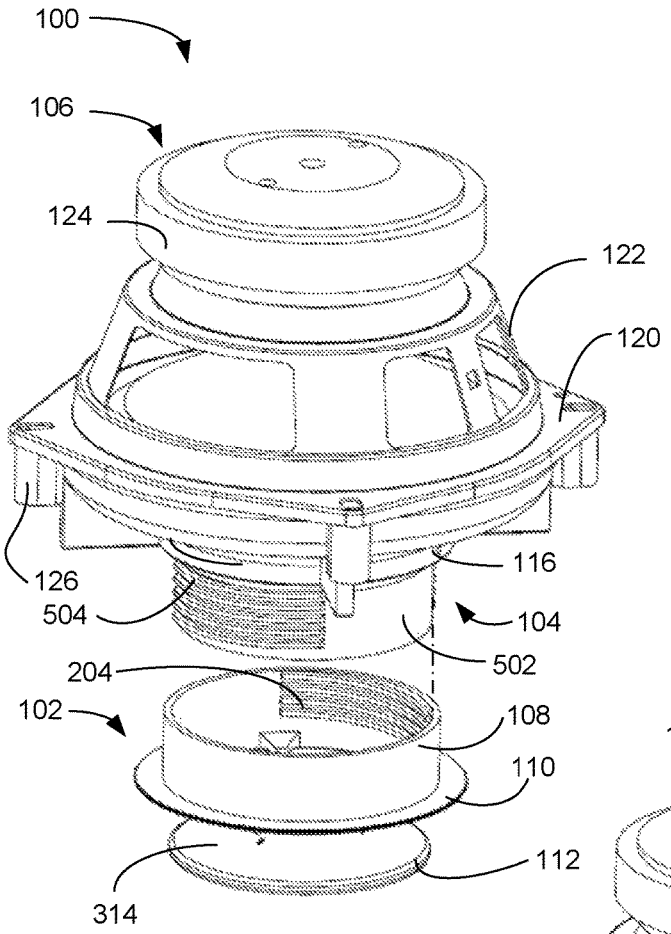
FIG. 8 is a side-top exploded perspective view illustrating the exemplary embodiment of the small ceiling speaker system of FIG. 1, according to a preferred embodiment of the present invention.

FIG. 8 is a side-top exploded perspective view illustrating the exemplary embodiment of the small ceiling speaker system 100 of FIG. 1, according to a preferred embodiment of the present invention. The full length of acoustic channel shell 502 is shown, which is preferably the same length as the diffuser barrel 108. Diffuser acoustic port 1902 (see FIG. 19) is near a minimum.

Figure 9:
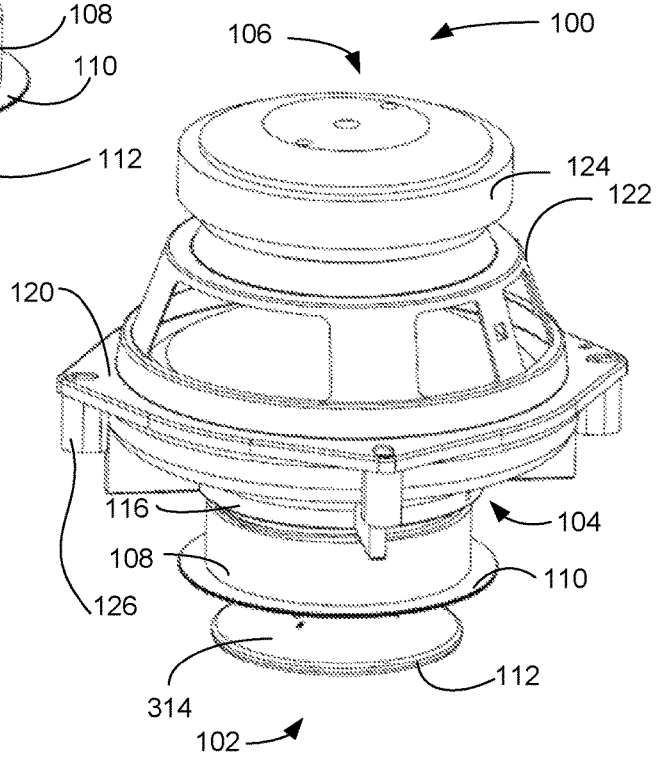
FIG. 9 is a side-top perspective view illustrating the exemplary embodiment of the small ceiling speaker system of FIG. 1 with the diffuser 102 in a contracted position, according to a preferred embodiment of the present invention.

FIG. 9 is a side-top perspective view illustrating the exemplary embodiment of the small ceiling speaker system 100 of FIG. 1 with the diffuser 102 in a contracted position, according to a preferred embodiment of the present invention. Diffuser 102 is adjusted for a minimum thickness ceiling tile 1016 (see FIG. 10). Diffuser acoustic port 1902 (see FIG. 19) is near a minimum.

FIG. 10 is a cross sectional elevation view illustrating the exemplary embodiment of the small ceiling speaker system 400 of FIG. 1 and FIG. 4 in a contracted position, according to a preferred embodiment of the present invention. Small ceiling speaker system 400 is shown supported on base 402 and covered by enclosure 404. A ceiling tile 1016 of small thickness for the illustrated embodiment is shown positioned with its bottom surface 1018 flush to a top surface of flange 110 and its top surface 1010 abutting base 402. The tweeter 1014 and details of the speaker 106 are shown. Diaphragm 1004 is driven by coil 1008. Diaphragm 1004 attaches to basket rim 120 via surround 1006. The deformation of surround 1006 is accommodated by surround accommodator 118. Channeling audio down through a smaller tube creates acoustic reflections adversely effecting sound quality. The acoustic channel 104 solves this problem by reducing internal reflections and allowing for a cleaner pressure wave to exit the small ceiling speaker system 100. Tweeter 1014 is oriented to project sound directly onto the radially symmetric outwardly descending diffuser upper surface 308 of diffuser 102. Diffuser element 314 includes the radially symmetric outwardly descending diffuser upper surface 308, the diffuser rim 112, the demarcations 302, the special demarcation 316, and the body on which such features are mounted. Electrical connectors 1002 on enclosure 404 provide audio signal connectivity through the enclosure 404.

Figure 11:
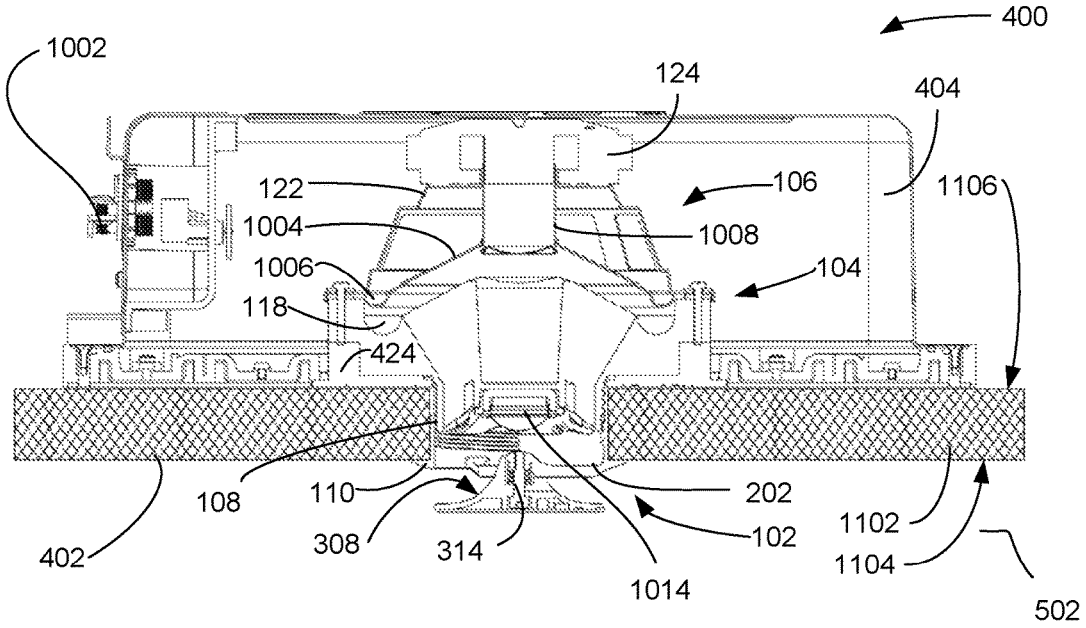
FIG. 11 is a cross sectional elevation view illustrating the exemplary embodiment of the small ceiling speaker system of FIG. 1 and FIG. 4 in an extended position, according to a preferred embodiment of the present invention.

FIG. 11 is a cross sectional elevation view illustrating the exemplary embodiment of the small ceiling speaker system 400 of FIG. 1 and FIG. 4 in an extended position, according to a preferred embodiment of the present invention. A ceiling tile 1102 of greater thickness for the illustrated embodiment is shown positioned with its bottom surface 1104 flush to a top surface of flange 110 and its top surface 1106 abutting base 402.

Figure 12:
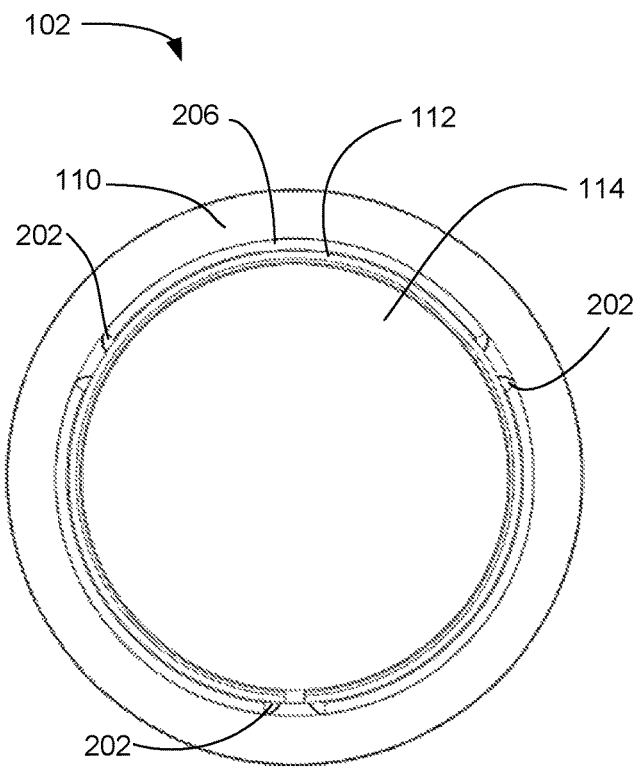
FIG. 12 is a bottom plan view illustrating the exemplary embodiment of the diffuser of the small ceiling speaker system of FIGS. 1 and 4, according to a preferred embodiment of the present invention.

FIG. 12 is a bottom plan view illustrating the exemplary embodiment of the diffuser 102 of the small ceiling speaker system 100 of FIGS. 1 and 4, according to a preferred embodiment of the present invention. The extension of inner radially downward sloping portion 206 beyond diffuser rim 112 as a support for diffuser element supports 202 can be seen. The diameter of flange 110 is preferably no larger than a fire suppression sprinkler head flange, enabling the small ceiling speaker system 100 to be unobtrusive. Cover plate 114 is seated within diffuser rim 112.

Figure 13:
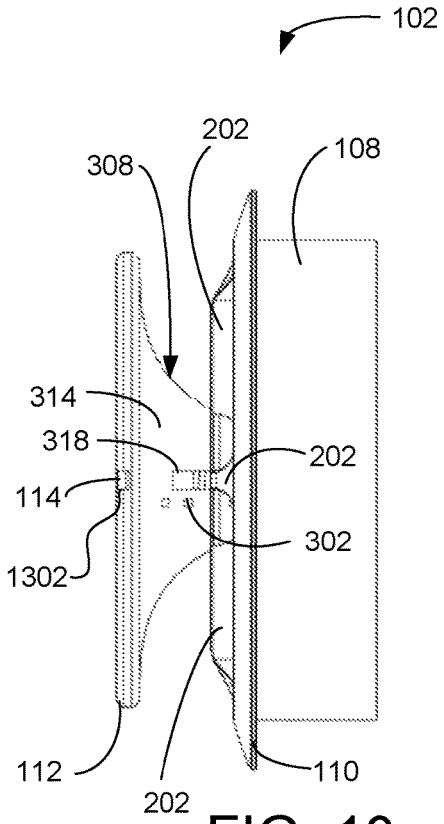
FIG. 13 is a side view illustrating the exemplary embodiment of the diffuser of the small ceiling speaker system of FIGS. 1 and 4, according to a preferred embodiment of the present invention.

FIG. 13 is a side view illustrating the exemplary embodiment of the diffuser 102 of the small ceiling speaker system 100 of FIGS. 1 and 4, according to a preferred embodiment of the present invention. Demarcations 302 provide a user with a visual indication of the extent that the diffuser element 314 has been adjusted away from flange 110. Groove 318 (one labeled of one visible of three) alongside of demarcations 302 receives diffuser element support 202 at all times and thereby prevents diffuser element 314 from rotating when fastener 1502 is rotated. The diffuser element 314 is shown at an intermediate distance from flange 110. Notch 1302 in diffuser rim 112 assists with removal of the cover plate 114.

Figure 14:
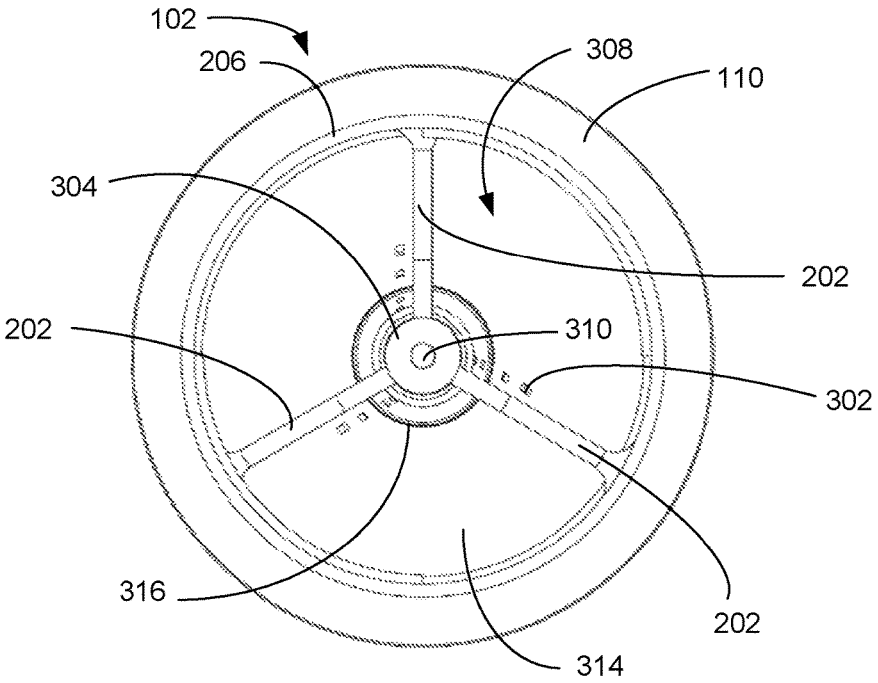
FIG. 14 is a top plan view illustrating the exemplary embodiment of the diffuser of the small ceiling speaker system of FIGS. 1 and 4, according to a preferred embodiment of the present invention.

FIG. 14 is a top plan view illustrating an exemplary embodiment of the diffuser 102 of the small ceiling speaker system 100 of FIGS. 1 and 4, according to a preferred embodiment of the present invention. Twelve demarcations 302 (one labeled) are shown in this view. The number of demarcations 302 is not a limitation of the present invention. Demarcations 302 are preferably printed onto radially symmetric outwardly descending diffuser upper surface 308. In other embodiments, demarcations 302 may be embossed, engraved, printed, laminated, or molded into the original radially symmetric outwardly descending diffuser upper surface 308.

Figure 15:
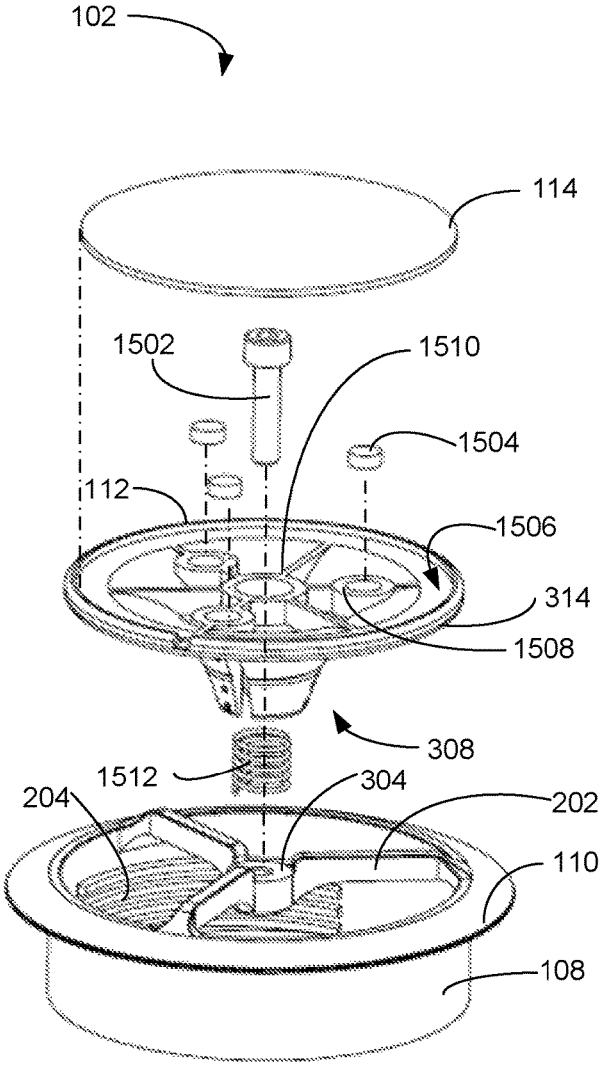
FIG. 15 is an exploded bottom-side perspective view illustrating the exemplary embodiment of the diffuser of the small ceiling speaker system of FIGS. 1 and 4, according to a preferred embodiment of the present invention.

FIG. 15 is an exploded bottom-side perspective view illustrating the exemplary embodiment of the diffuser 102 of the small ceiling speaker system 100 of FIGS. 1 and 4, according to a preferred embodiment of the present invention. Diffuser element 314 includes a cover plate support surface 1506, three magnet cups 1508 and a spring-receiving cavity 1510 for containing coil spring 1512. Fastener 1502, illustrated as an Allen-head screw, is to be inserted into the spring-receiving cavity 1510 and within the coil of coil spring 1512 and threaded into threaded bore 312 of hub 304. Magnets 1504 (one labeled of three) are secured in magnet cups 1508 (one labeled of three) and are used to hold cover plate 114 in place within diffuser rim 112. Once installed, rotating fastener 1502 adjusts the distance between diffuser element 314 and flange 110 and, consequently, the size of diffuser acoustic port 1902 (see FIG. 19). The extent of the range of adjustability of the diffuser acoustic port 1902 is predetermined by the threaded length of fastener 1502 and the threaded length of threaded bore 312 in hub 304.

Figure 16:
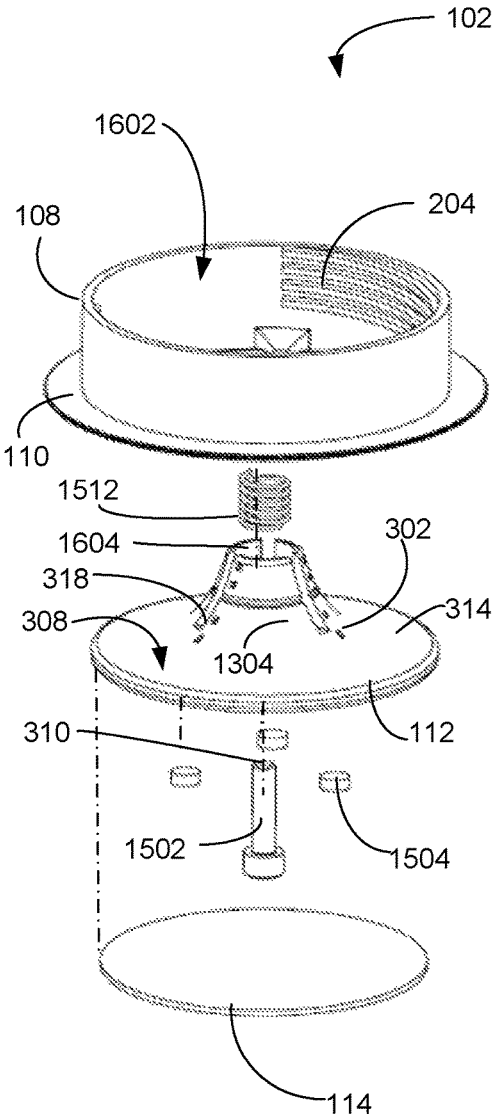
FIG. 16 is an exploded top-side perspective view illustrating the exemplary embodiment of the diffuser of the small ceiling speaker system of FIGS. 1 and 4, according to a preferred embodiment of the present invention.

FIG. 16 is an exploded top-side perspective view illustrating the exemplary embodiment of the diffuser 102 of the small ceiling speaker system 100 of FIGS. 1 and 4, according to a preferred embodiment of the present invention. An unthreaded portion 1602 of the interior surface 208 of diffuser barrel 108 can be seen bracketing diffuser threads 204 and 306. Spring-receiving opening 1604 in diffuser element 314 can be seen in this view. Two of the grooves 318 can be seen in this view.

Figure 17:
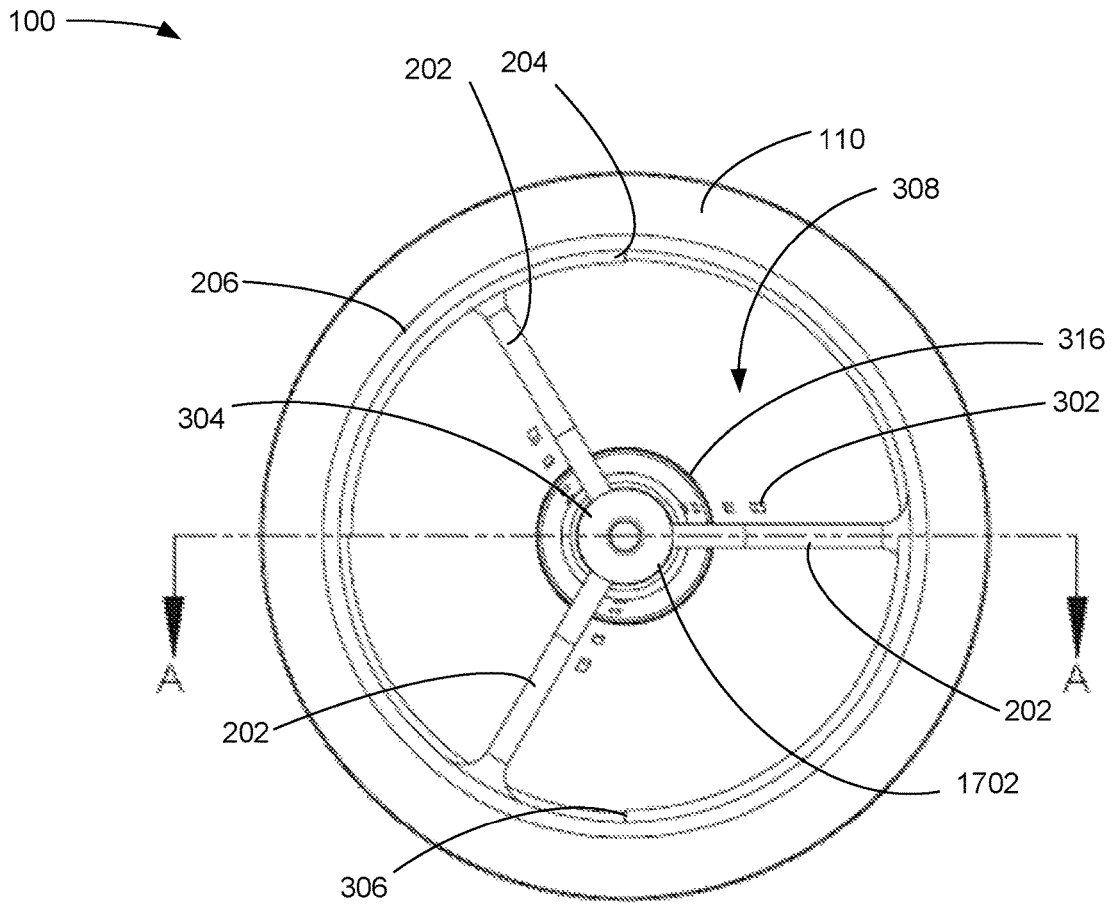
FIG. 17 is a top plan view illustrating the exemplary embodiment of the diffuser of the small ceiling speaker system of FIG. 1 and defining cross section AA, according to a preferred embodiment of the present invention.

FIG. 17 is a top plan view illustrating the exemplary embodiment of the diffuser 102 of the small ceiling speaker system 100 of FIGS. 1 and 4, and defining cross section AA, according to a preferred embodiment of the present invention. A collar 1702 on diffuser element 314 that surrounds spring-receiving opening 1604 into diffuser element 314 is noticeable in this view.

Figure 18:
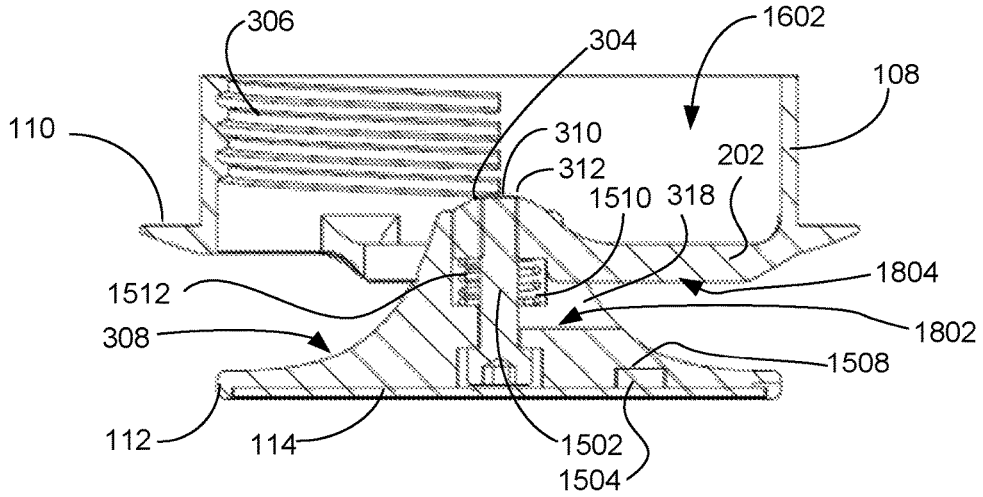
FIG. 18 is a side cross sectional view through cross section AA illustrating the exemplary embodiment of the diffuser of the small ceiling speaker system of FIGS. 1 and 4, according to a preferred embodiment of the present invention.

FIG. 18 is a side cross sectional view through cross section AA illustrating the exemplary embodiment of the diffuser 102 of the small ceiling speaker system 100 of FIGS. 1 and 4, according to a preferred embodiment of the present invention. Coil spring 1512 is shown compressed within spring receiving cavity 1510 and capped by hub 304. Fastener 1502 extends through the coil of coil spring 1512 and threads into hub 304. Fastener 1502 is preferably captive, once the small ceiling speaker system 100 is assembled. Magnet 1504 is secured in magnet cup 1508 by adhesive, friction, screw threads, snap fit, or similarly effective means. A cross section of groove 318 is visible in this view, and shows that the groove 318 is deepest nearer the center of diffuser element 314 and has a flat bottom surface 1802 to receive the flat bottom 1804 of diffuser element support 202. In various embodiments, the bottom surface 1802 of the groove 318 and the bottom 1802 of the diffuser element support 202 may be other than flat, within the constraint that they are conformal. In other various embodiments that shapes need not be conformal.

Figure 19:
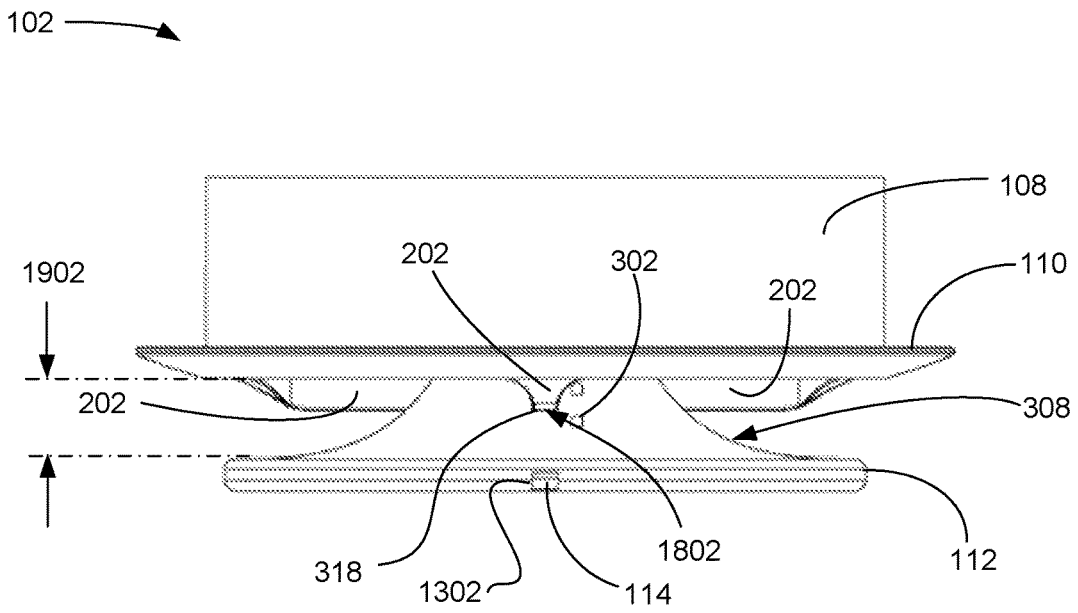
FIG. 19 is a side elevation view illustrating the exemplary embodiment of the diffuser of the small ceiling speaker system of FIGS. 1 and 4, with the acoustic port reduced, according to a preferred embodiment of the present invention.

FIG. 19 is a side elevation view illustrating the exemplary embodiment of the diffuser 102 of the small ceiling speaker system 100 of FIGS. 1 and 4, with the diffuser acoustic port 1902 reduced, according to a preferred embodiment of the present invention. Diffuser acoustic port 1902 is shown almost at a reduced size, as shown by the small distance between diffuser element supports 202 and the flat bottom surface 1802 of groove 318 in diffuser element 314.

Figure 20:
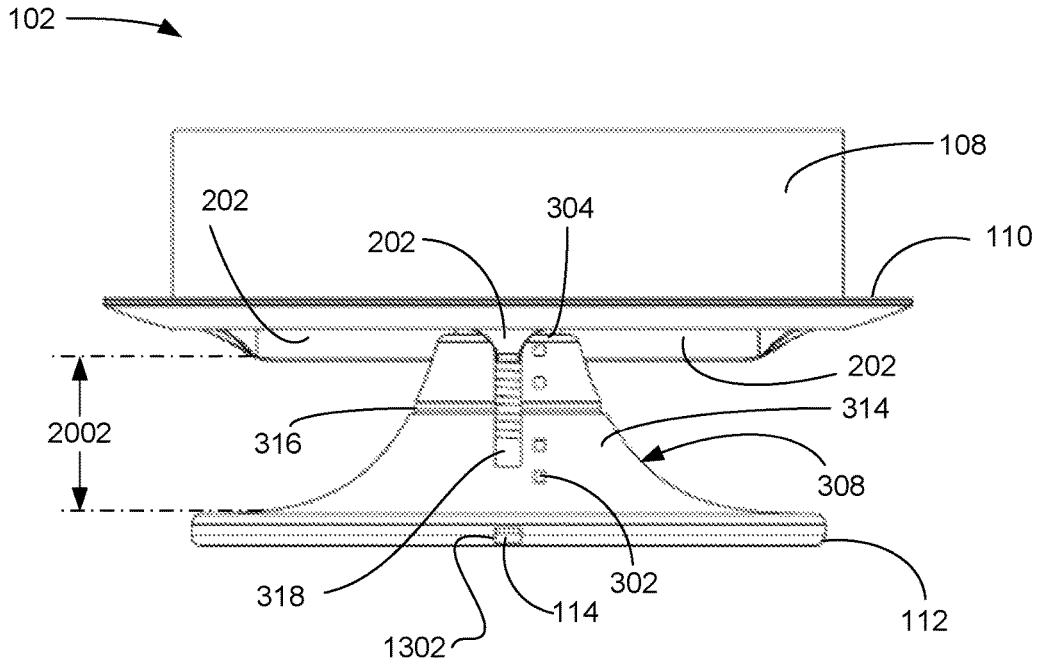
FIG. 20 is a side elevation view illustrating the exemplary embodiment of the diffuser of the small ceiling speaker system of FIGS. 1 and 4 with the acoustic port enlarged, according to a preferred embodiment of the present invention.

FIG. 20 is a side elevation view illustrating the exemplary embodiment of the diffuser 102 of the small ceiling speaker system 100 of FIG. 1 with the diffuser acoustic port 2002 enlarged, according to a preferred embodiment of the present invention. Diffuser acoustic port 2002 is shown at nearly a maximum size, as shown by separation between diffuser element supports 202 and diffuser element 314.

Figure 21A:
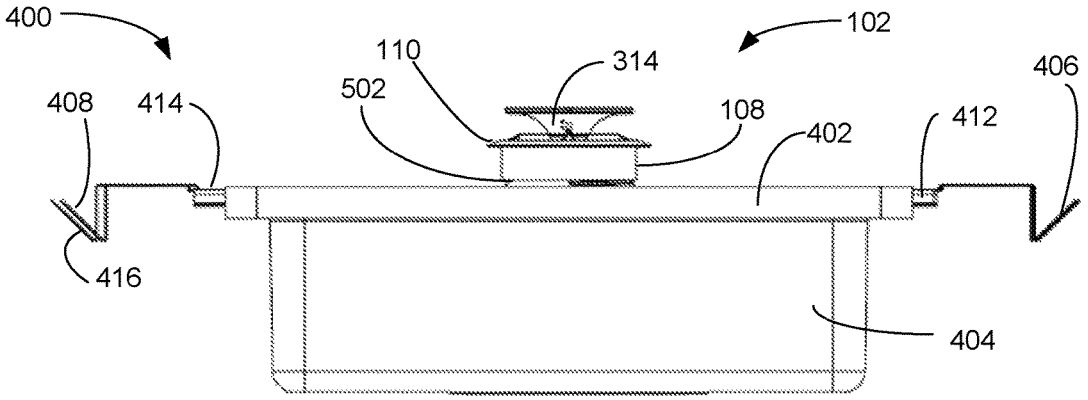
FIG. 21A is a front side elevation view illustrating the exemplary embodiment of the small ceiling speaker system FIGS. 1, 4, and 10 with enclosure and braces, according to a preferred embodiment of the present invention.

FIG. 21A is a front side elevation view illustrating the exemplary embodiment of the small ceiling speaker system 400 of FIGS. 1, 4 and 10 with enclosure 404 and braces 406, 408, 410, and 416, according to a preferred embodiment of the present invention. The front side is arbitrarily designated as the side opposite the side having electrical connectors 1002.

Figure 21B:
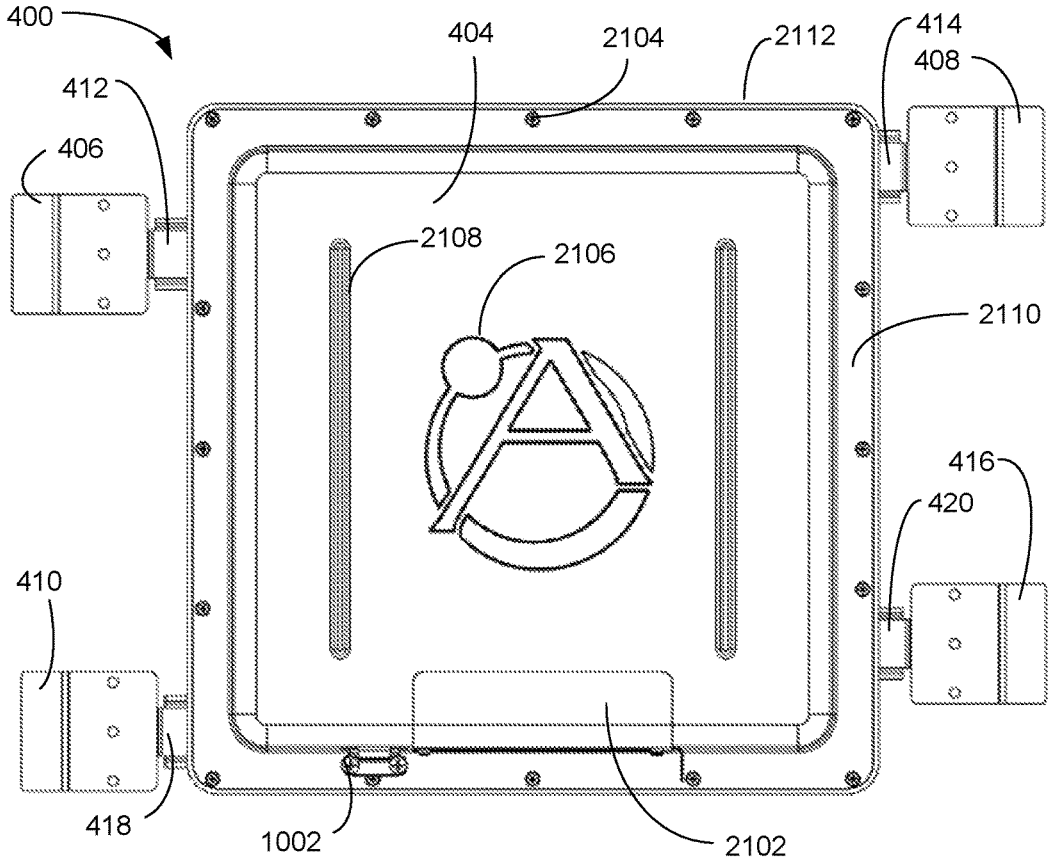
FIG. 21B is a top plan view illustrating the exemplary embodiment of the small ceiling speaker system and enclosure of FIGS. 1, 4, and 10 with enclosure and braces, according to a preferred embodiment of the present invention.

FIG. 21B is a top plan view illustrating the exemplary embodiment of the small ceiling speaker system 400 of FIGS. 1, 4, and 10 with enclosure 404 and braces 406, 408, 410, and 416, according to a preferred embodiment of the present invention. Access panel 2102 is releasably fastened to enclosure 404. Enclosure 404 includes perimeter flange 2110, which fits within rim 2112 of base 402. Perimeter flange 2110, and thus enclosure 404, is held to base 402 with fasteners 2104 (one of sixteen labeled). Decorative vent 2106 assists in releasing hot air from within enclosure 404, as do vents 2108 (one of two labeled).

Figure 21C:
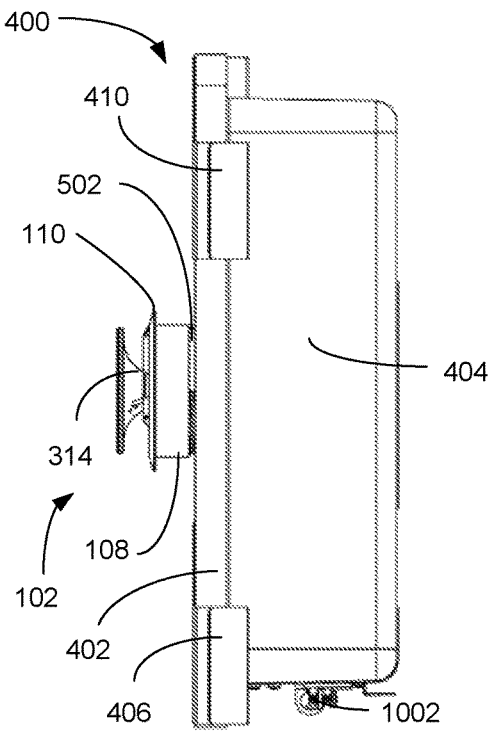
FIG. 21C is a rotated left side elevation view illustrating an exemplary embodiment of the small ceiling speaker system of FIGS. 1, 4, and 10 with enclosure and braces, according to a preferred embodiment of the present invention.

FIG. 21C is a rotated left side elevation view illustrating an exemplary embodiment of the small ceiling speaker system 400 of FIGS. 1, 4, and 10 with enclosure 404 and braces 406 and 410, according to a preferred embodiment of the present invention. While the illustrated enclosure 404 and base 402 are preferred, those of skill in the art, illuminated by the present disclosure, will understand that a wide variety of enclosures of various shapes and sizes may support ceiling speaker 106, acoustic channel 104, and diffuser 102 within the scope of the present invention.

Figure 21D:
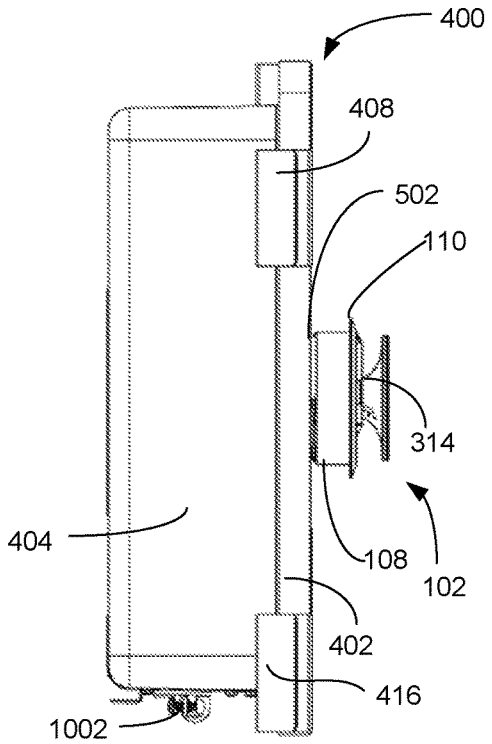
FIG. 21D is a rotated right side elevation view illustrating an exemplary embodiment of the small ceiling speaker system of FIGS. 1, 4, and 10 with enclosure and braces, according to a preferred embodiment of the present invention.

FIG. 21D is a rotated right side elevation view illustrating an exemplary embodiment of the small ceiling speaker system 400 of FIGS. 1 and 10 with enclosure 404 and braces 408 and 416, according to a preferred embodiment of the present invention. Enclosure 404 is preferably made of metal. Base 402 is preferably made of injection molded plastic. In various other embodiments, other materials may be used that meet similar strength, durability, and fire code requirements as the preferred materials.

Figure 21E:
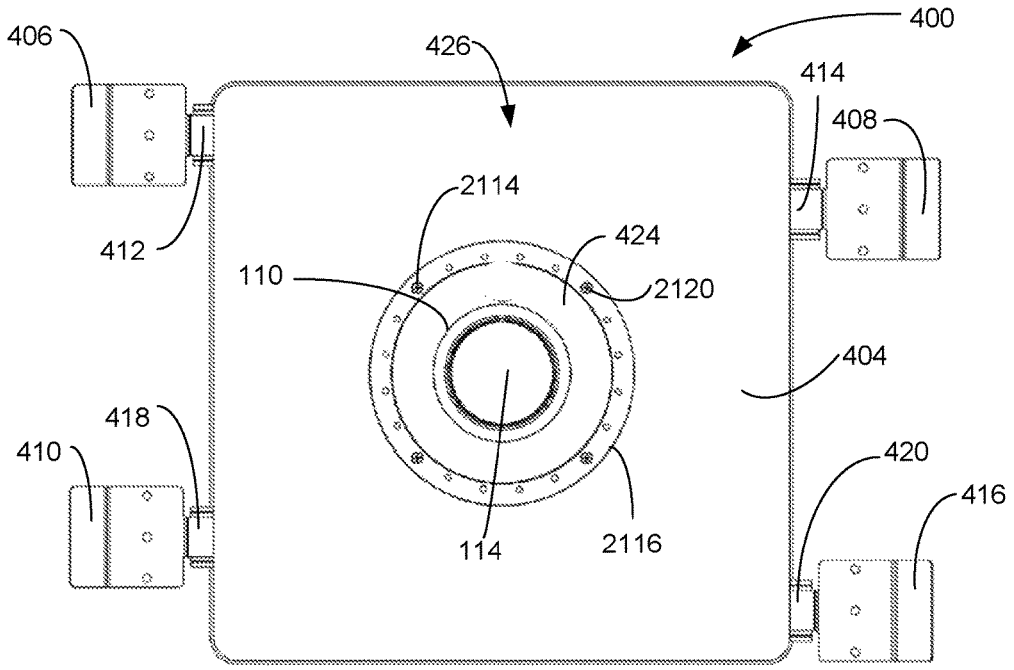
FIG. 21E is a bottom plan view illustrating an exemplary embodiment of the small ceiling speaker system of FIGS. 1, 4, and 10 with enclosure and braces, according to a preferred embodiment of the present invention.

FIG. 21E is a bottom plan view illustrating an exemplary embodiment of the small ceiling speaker system 400 of FIGS. 1, 4, and 10 with enclosure 404 and braces 406, 408, 410, and 416, according to a preferred embodiment of the present invention. The illustrated portion of carrier 424 is the bottom surface of carrier 424, which preferably sits flush with the bottom surface 426 of base 402, supports the small speaker system 100, and releasably fastens to base 402. The advantage of this approach is that the speaker 106 and tweeter 1014 can be accessed without otherwise opening the enclosure 404. The bottom of carrier 424 is an annular piece with an optional delineated outer ring 2116 having fastener openings 2120 (one of four labeled) for fasteners 2114 (one of four labeled), illustrated here as screws 2114. In various embodiments, the outer ring 2116 may not be delineated and there may be more or fewer fastener openings 2120.

Figure 21F:
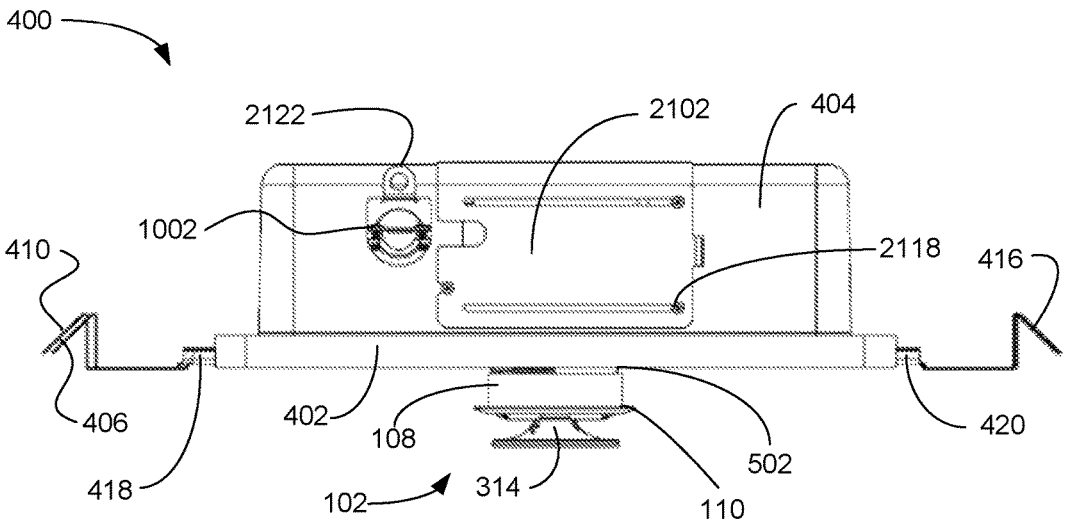
FIG. 21F is a rear side elevation view illustrating an exemplary embodiment of the small ceiling speaker system of FIGS. 1 and 10 with enclosure and braces, according to a preferred embodiment of the present invention.

FIG. 21F is a rear side elevation view illustrating an exemplary embodiment of the small ceiling speaker system 400 of FIGS. 1, 4, and 10 with enclosure 404 and braces 406, 410, and 416, according to a preferred embodiment of the present invention. Access panel 2102 is releasably secured by fasteners 2118 (one of three labeled). Strain relief loop 2122 reduces strain on electrical wires attached to electrical connectors 1002.

Figure 22:
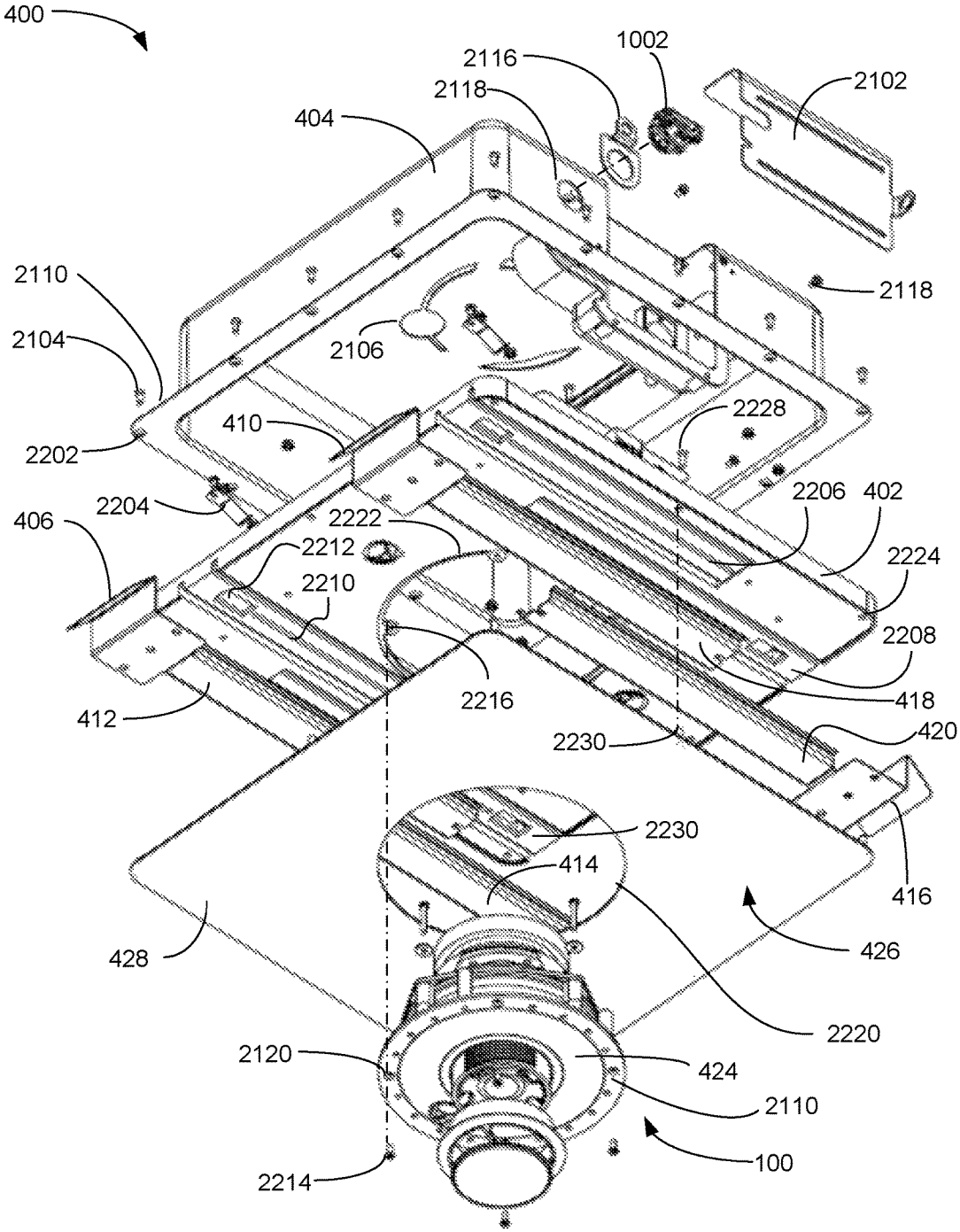
FIG. 22 is a bottom exploded perspective view illustrating an exemplary embodiment of the small ceiling speaker system of FIGS. 1, 4, and 10, according to a preferred embodiment of the present invention.

FIG. 22 is a low-angle rear exploded view illustrating an exemplary embodiment of the small ceiling speaker system 400 of FIGS. 1, 4, and 10, according to a preferred embodiment of the present invention. Electrical connectors 1002 are seen to be on a threaded plug to be installed in opening 2218 that uses a lower opening on strain relief loop 2122 as a washer and is secured with a nut (not shown). Perimeter flange 2110 of enclosure 404 has predrilled fastener holes 2202 (one of ten visible labeled) for fastening to base 402, which has corresponding fastener holes (not shown) for fasteners 2104 (one of nine visible labeled). Reed spring 2204 (one of two visible of four labeled) is attachable to extend through spring window 2212 in track 2210 to provide friction for extendable rail 412, when mounted. Tracks 2206 and 2208 are similarly equipped for rails 418 and 420, respectively. Rail 414 has a similarly equipped guide (not visible in this view). Opening 2222 in base 402 has four inwardly extending tabs 2216 (one of two visible of four labeled) for receiving fasteners 2214 (one of four labeled) to fasten the carrier 424 to the base 402. Opening 2220 in bottom panel 438 aligns with opening 2222 in base 402. Base fasteners 2228 (one of two visible labeled) fasten to fastener fittings 2230 extending from a top surface of bottom panel 428 via fastener holes 2224 (one of three visible labeled).

Figure 23:
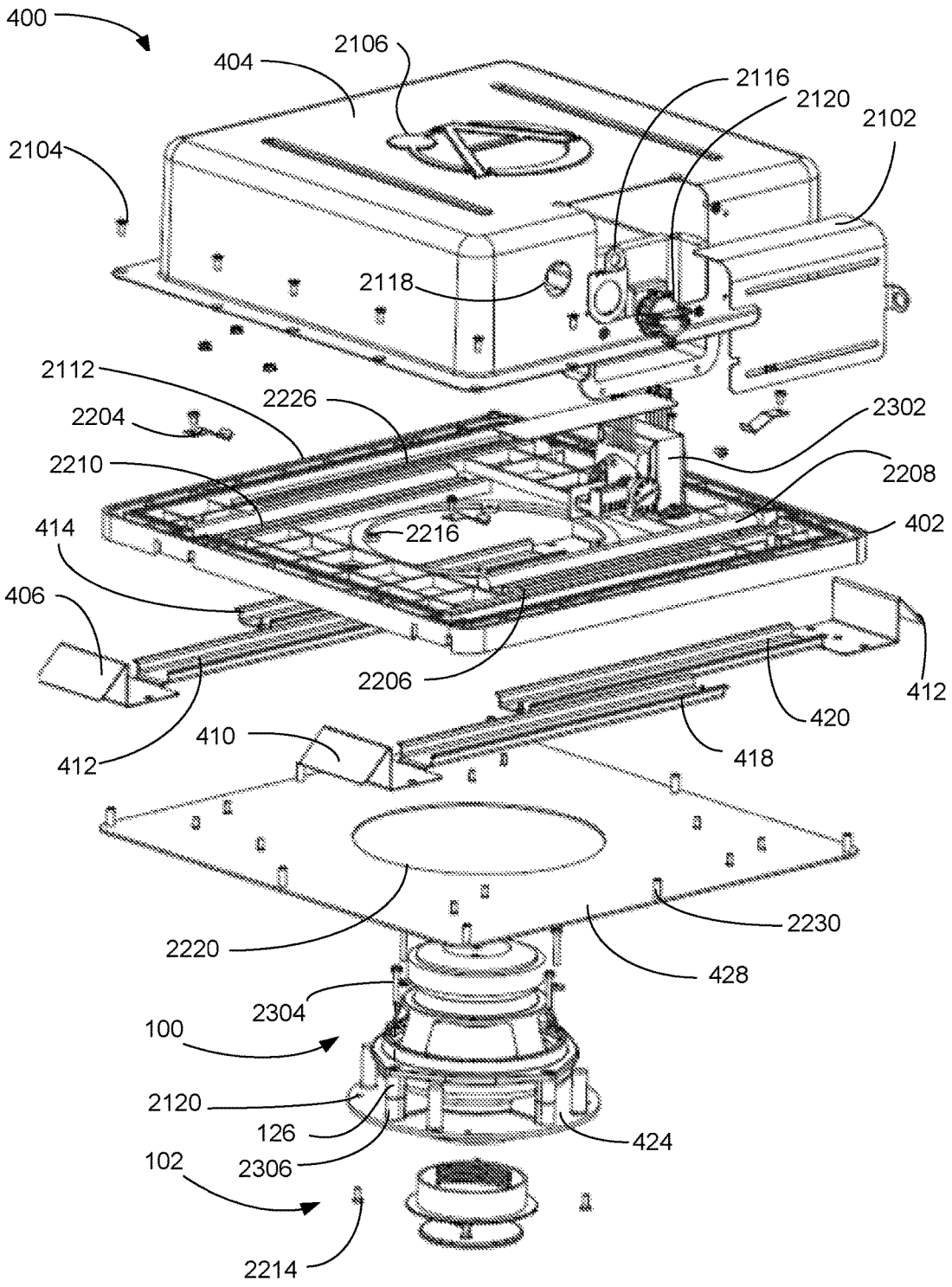
FIG. 23 is a top exploded perspective view illustrating an exemplary embodiment of the small ceiling speaker system of FIGS. 1 and 10, according to a preferred embodiment of the present invention.

FIG. 23 is a high-angle rear exploded view illustrating an exemplary embodiment of the small ceiling speaker system 400 of FIGS. 1, 4, 10 and 22, according to a preferred embodiment of the present invention. Electronics, including a multi-tapped transformer 2302 can be seen mounted on base 402. In various embodiments, respectively various electronics packages, such as amplifiers, filters, controls, etc., may be mounted on base 402. Fastener fittings 2230 (one of seven visible of eight labeled) may be better seen in this view. Carrier fastener receivers 2306 extend upwards from annular plate 2602 (see FIG. 26A) to align with support fittings 126 and then fasteners 2304 extend through speaker basket rim 120, support fittings 126, and into carrier fastener receivers 2306 to fasten the small ceiling speaker system 100 to the carrier 424.

Figure 24:
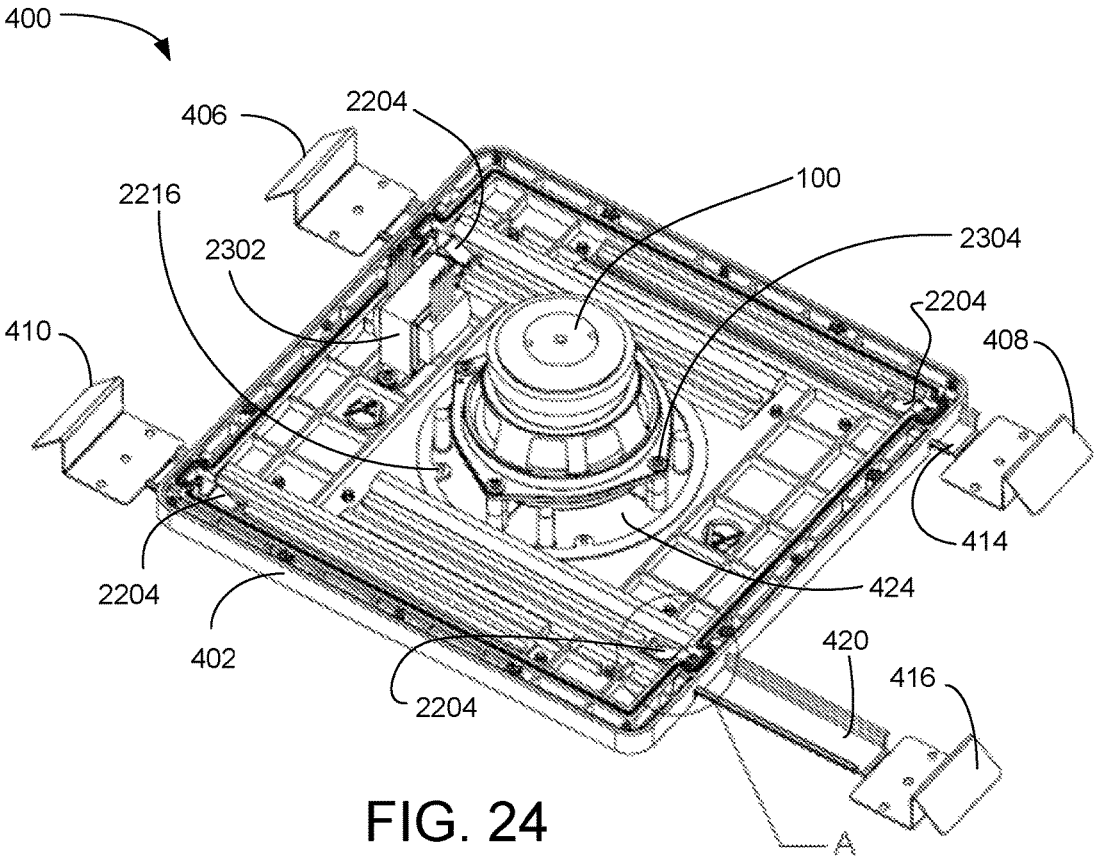
FIG. 24 is a top perspective view illustrating an exemplary mounted base of the exemplary embodiment of the small ceiling speaker system of FIGS. 1 and 10 and delineating detail A, according to a preferred embodiment of the present invention.

FIG. 24 is a top perspective view illustrating an exemplary mounted base of the exemplary embodiment of the small ceiling speaker system of FIGS. 1, 4, 10, and 23 and delineating detail A, according to a preferred embodiment of the present invention. The carrier 424 is fastened to the base 402 at tabs 2216 and to the speaker with fasteners 2304, thereby completing the mounting of small ceiling speaker system 100 to the base 402.

Figure 25:
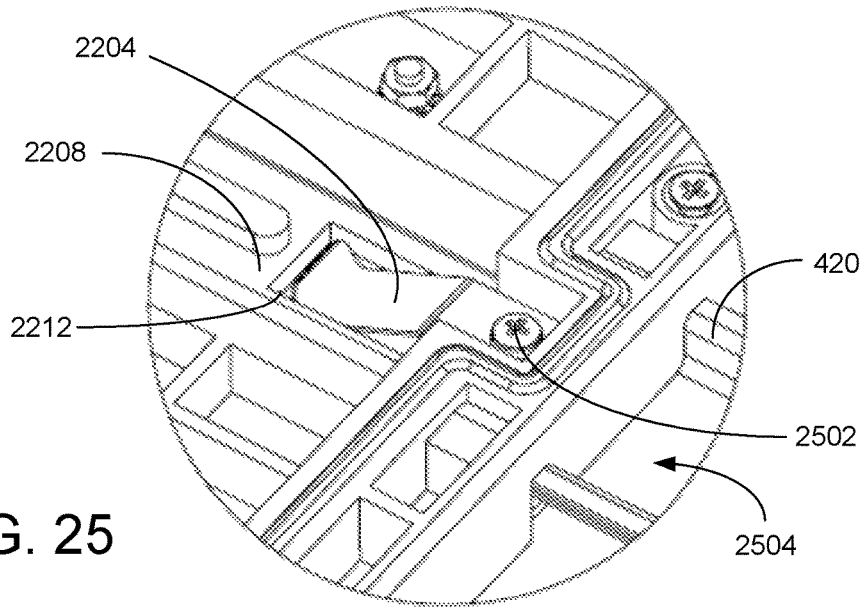
FIG. 25 is a top perspective view illustrating an exemplary detail A of the mounted base of the exemplary embodiment of the small ceiling speaker system of FIGS. 1 and 10, according to a preferred embodiment of the present invention.

FIG. 25 is a top perspective view illustrating an exemplary detail A of the mounted base 402 of the exemplary embodiment of the small ceiling speaker system 400 of FIGS. 1, 4, 10 and 23, according to a preferred embodiment of the present invention. Reed spring 2204 is secured with fastener 2502 to extend through spring window 2212 in track 2208 to frictionally engage a surface 2504 of rail 420. Each track 412, 414, 418, and 420 is similarly arranged to frictionally engage its respective rail 2210, 2226, 2206, and 2208.

Figure 26A:
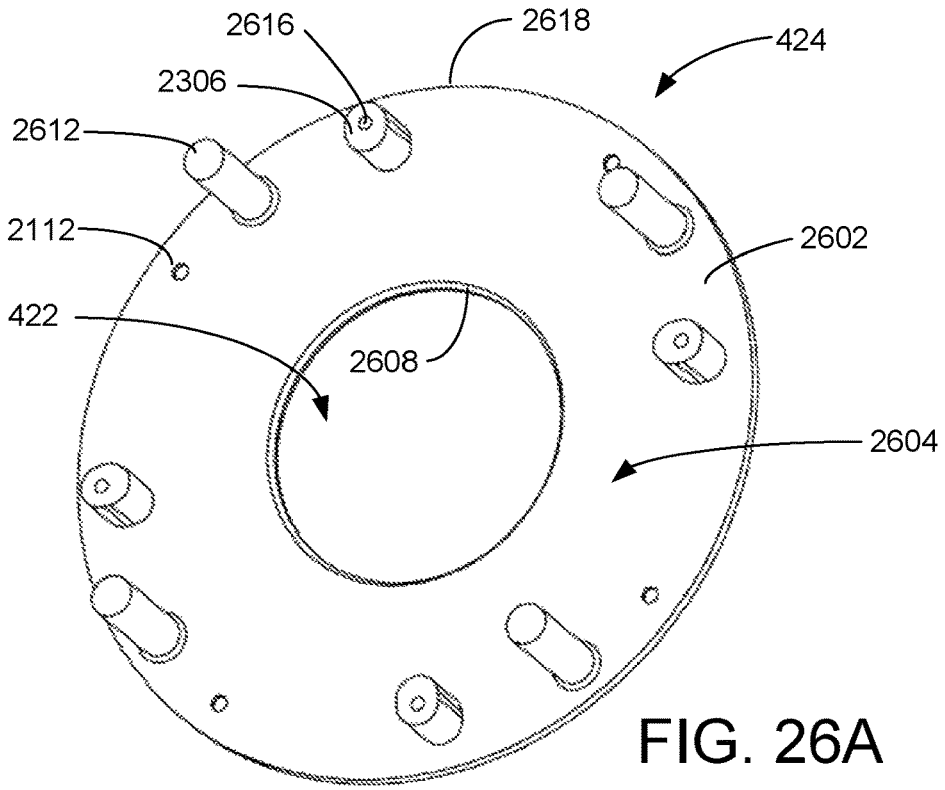
FIG. 26A is a top perspective view illustrating an exemplary embodiment of a carrier of the exemplary embodiment of the small ceiling speaker system of FIGS. 1, 10 and 23, according to a preferred embodiment of the present invention.

FIG. 26A is a top perspective view illustrating an exemplary embodiment of a carrier 424 of the exemplary embodiment of the small ceiling speaker system of FIGS. 1, 10, and 23, according to a preferred embodiment of the present invention. Carrier 424 is a physical interface between the speaker 106 and the base plate 402. Carrier 424 includes an annular plate 2602 having an outer perimeter 2618, a top surface 2604, and an inner opening 2606 with a perimeter 2608. Inner opening 2606 is sized to receive acoustic channel shell 502. Extending upward from the top surface 2604 are four alignment pins 2612 (one of four labeled) that fit, as a group, slidingly within openings 2220 and 2222. Also extending upward from the top surface 2604 are four carrier fastener receivers 2306 with threaded bores 2616 (one of four of each labeled). Carrier fastener receivers ions 2306 align to support fittings 126 to receive fasteners 2314, such as bolts 2314, to fasten the carrier 424 to the speaker 106. Fastener openings 2120 align with tabs 2216 to receive fasteners 2214 to fasten the carrier 424 to the base 402. In various embodiments using speakers 106 having respective various patterns of support fittings 126, the arrangement of carrier fastener receivers 2306 may be complimentary to the support fittings 126. The advantage of carrier 424 is that it enables removal of the speaker 106 for maintenance or replacement without otherwise opening enclosure 404.

Figure 26B:
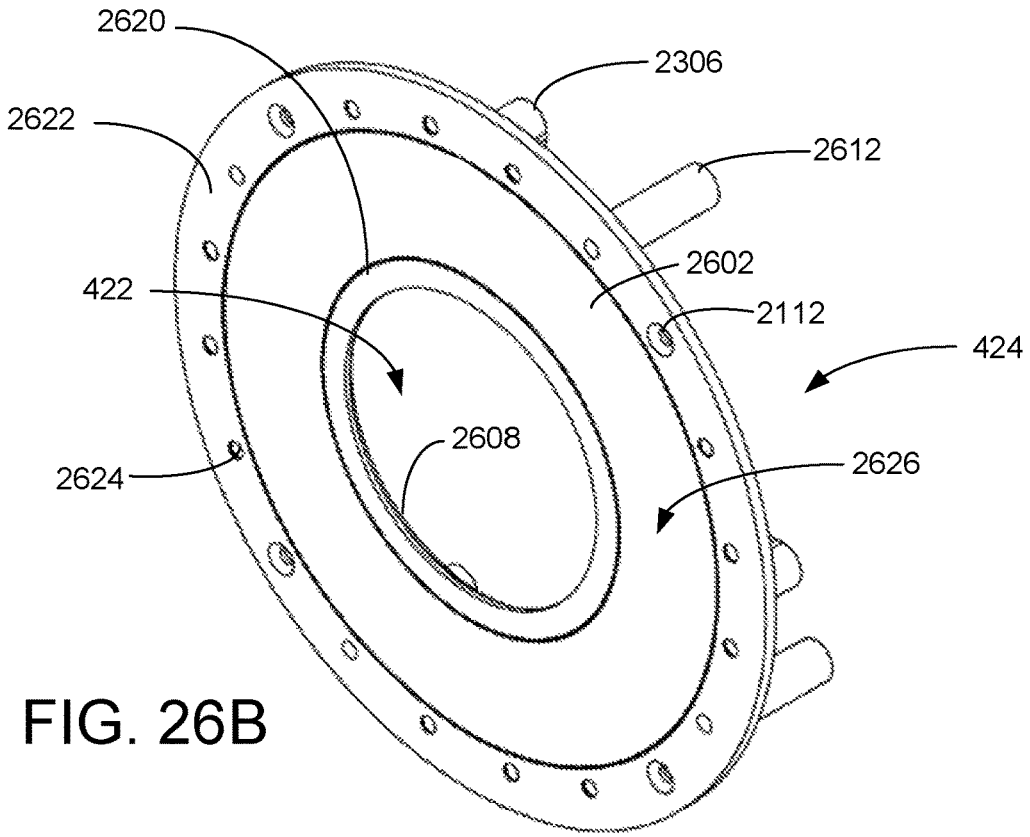
FIG. 26B is a bottom perspective view illustrating an exemplary embodiment of the carrier of the exemplary embodiment of the small ceiling speaker system of FIGS. 1, 10, 23, and 26A, according to a preferred embodiment of the present invention.

FIG. 26B is a bottom perspective view illustrating an exemplary embodiment of a carrier 424 of the exemplary embodiment of the small ceiling speaker system 100 of FIGS. 1, 10, 23, and 26A, according to a preferred embodiment of the present invention. The outer rim 2622 is preferably flush with bottom surface 2626 of annular plate 2602. The inner rim 2520 is preferably flush with bottom surface 2626 of annular plate 2602. In some embodiments, the delineation of outer rim 2622 and/or inner rim 2620 may be omitted. The indentations 2624 (one of sixteen labeled) have no function beyond aesthetics.

Figure 26D:
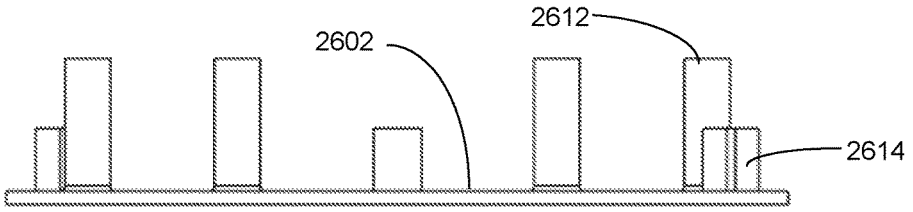
FIG. 26D is a front elevation view illustrating the exemplary embodiment of the carrier of the exemplary embodiment of the small ceiling speaker system of FIGS. 1, 10, 23, and 26A, according to a preferred embodiment of the present invention.
Figure 26C:
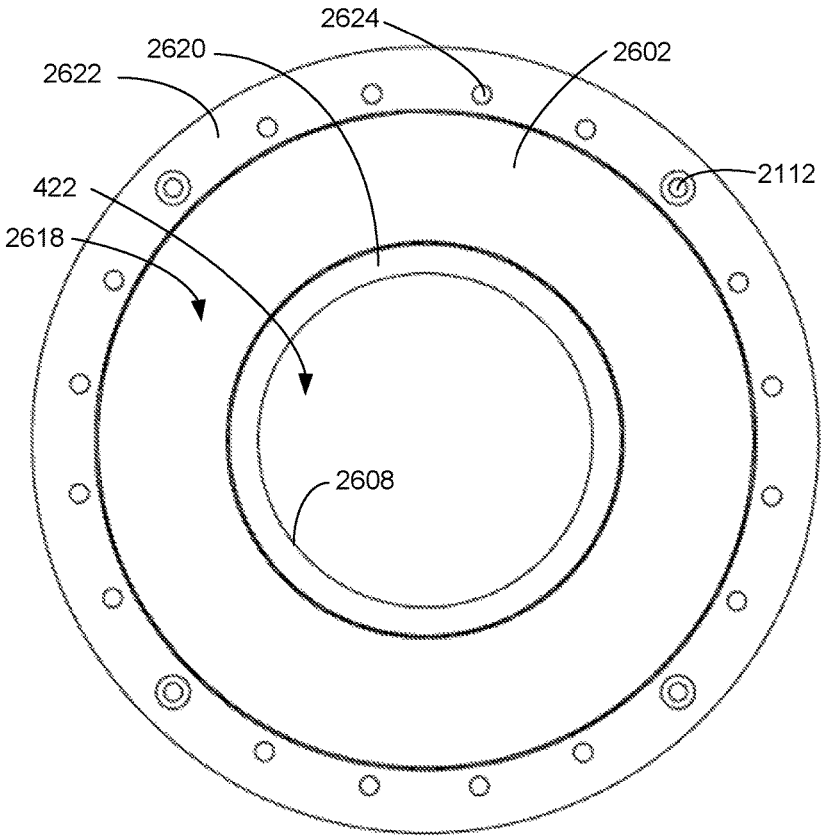
FIG. 26C is a bottom plan view illustrating the exemplary embodiment of the carrier of the exemplary embodiment of the small ceiling speaker system of FIGS. 1, 10, 23, and 26A 6A, according to a preferred embodiment of the present invention.

FIG. 26C is a bottom plan view illustrating the exemplary embodiment of the carrier 424 of the exemplary embodiment of the small ceiling speaker system 100 of FIGS. 1, 10, 23, and 26A, according to a preferred embodiment of the present invention. Alignment pins 2612 are arranged at corners of an imaginary square, which just fits into openings 2220 and 2222. In some embodiments, other patterns having the same functionality may be used. Fastener openings 2120 may be countersunk, such that no portion of a fastener extends below the bottom surface 2626. In some embodiments, outer rim 2622 may be thicker than annular plate 2602.

FIG. 26D is a front elevation view illustrating the exemplary embodiment of the carrier 424 of the exemplary embodiment of the small ceiling speaker system 100 of FIGS. 1, 10, 23, and 26A, according to a preferred embodiment of the present invention. Alignment pins 2612 are taller than carrier fastener receivers 2306 in order to engage the inner edges of openings 2220 and 2222. The two vertical lines on the labeled carrier fastener receivers 2306 delineate the flat portion of the side of carrier fastener receivers 2306.

Figure 26E:
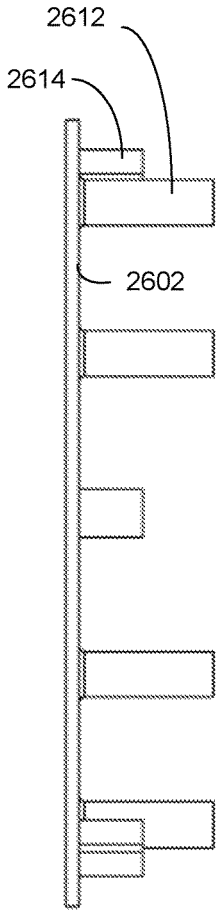
FIG. 26E is a side elevation view illustrating the exemplary embodiment of the carrier of the exemplary embodiment of the small ceiling speaker system of FIGS. 1, 10, 23, and 26A, according to a preferred embodiment of the present invention.

FIG. 26E is a side elevation view illustrating the exemplary embodiment of the carrier 424 of the exemplary embodiment of the small ceiling speaker system 100 of FIGS. 1, 10, 23, and 26A, according to a preferred embodiment of the present invention. Preferably, carrier 424 is made of one piece. More preferably, carrier 424 is made of one piece of injection-molded plastic.

I claim:

1. A small ceiling speaker system comprising:
- a. an acoustic diffuser having an adjustable length; and
- b. said acoustic diffuser having a bidirectionally adjustable acoustic port independent of said adjustable length;
- c. a housing including:
  - i. a base:
    - 1. supporting said small ceiling speaker; and
    - 2. having an opening through which said acoustic diffuser extends; and
  - ii. an enclosure coupled to said base.

2. The system of claim 1, comprising:
- a. a loudspeaker having an acoustic output;
- b. an acoustic channel extending axially from said loudspeaker.

3. The system of claim 2, wherein said acoustic channel comprises:
- a. an acoustic channel cone extending axially from said speaker and adapted to channel sound output from a front end of said speaker; and
- b. a cylindrical acoustic channel shell extending axially from said acoustic channel cone.

4. The system of claim 3, comprising a tweeter mounted in said acoustic channel shell.

5. The system of claim 3, comprising two opposed spaced apart sets of external shell threads, each set extending no more than ninety degrees around said acoustic channel shell.

6. The system of claim 5, wherein said acoustic diffuser comprises:
- a. a diffuser barrel comprising a cylindrical shell;
- b. two opposed spaced apart sets of internal diffuser threads, each set extending no more than ninety degrees around an internal surface of said diffuser barrel;
- c. a circumferential flange extending radially inward and outward from a lower end of said diffuser barrel; and
- d. a plurality of diffuser element supports:
  - i. extending radially inward from said radially inward extending portion of said flange; and
  - ii. converging to, and of one piece with, an axially central hub;
- e. a threaded bore in said hub.

7. The system of claim 5, wherein said acoustic diffuser comprises a diffuser element, further comprising:
- a. a body having a circular circumference;
- b. an upper radially symmetric outwardly descending diffuser surface on said body;
- c. a plurality of demarcations on said upper radially symmetric outwardly descending diffuser surface;
- d. a plurality of radial grooves in said upper radially symmetric outwardly descending diffuser surface, each positioned to receive one diffuser element support of said plurality of diffuser element supports;
- e. a flat lower surface on said body;
- f. a circumferential rim on said lower surface of said body;
- g. a central bore through said body in three diameters configured to receive:
  - i. a coiled spring
  - ii. a fastener; and
  - iii. a fastener head; and
- h. a fastener having a head and a threaded portion and sized to extend through and beyond said central bore.

8. The system of claim 7, comprising:
- a. a plurality of magnet cups bored into said lower surface;
- b. a magnet secured in each said magnet cup of said plurality of magnet cups; and
- c. a cover plate magnetically secured to said lower surface within said rim via said plurality of said magnets.

9. The system of claim 1, comprising:
- a. first and second braces configured to rest on members of a suspended ceiling grid; and
- b. a first set of first and second extendable rails extending from a first side of said base to support said first brace; and
- c. a second set of first and second extendable rails extending from an opposing second side of said base to support said second brace.

10. A small ceiling speaker system comprising:
- a. an acoustic diffuser having an adjustable length; wherein said acoustic diffuser comprises:
  - i. a diffuser barrel comprising a cylindrical shell;
  - ii. two opposed spaced apart sets of internal diffuser threads, each set extending no more than ninety degrees around an internal surface of said diffuser barrel;
  - iii. a circumferential flange extending radially inward and outward from a lower end of said diffuser barrel; and
  - iv. a plurality of diffuser element supports:
    - 1. extending radially inward from said radially inward extending portion of said flange; and
    - 2. converging on, and of one piece with, an axially central hub;

v. a threaded bore in said hub, and b. said acoustic diffuser having an adjustable acoustic port independent of said adjustable length.

11. The system of claim 10, wherein said acoustic diffuser comprises a diffuser element, further comprising:

a. a body having a circular circumference;

b. an upper radially symmetric outwardly descending diffuser surface on said body;

c. a plurality of demarcations on said upper radially symmetric outwardly descending diffuser surface;

d. plurality of radial grooves in said upper radially symmetric outwardly descending diffuser surface, each positioned to receive one diffuser element support of said plurality of diffuser element supports;

e. a flat lower surface on said body;

f. a circumferential rim on said lower surface of said body;

g. a central bore through said body in three diameters configured to receive:

i. a coiled spring ii. a fastener; and iii. a fastener head;

iv. a fastener having a head and a threaded portion and sized to extend through and beyond said central bore.

12. The system of claim 11, comprising:

a. a loudspeaker having an acoustic output;

b. an acoustic channel extending from said loudspeaker, wherein said acoustic channel comprises:

i. a acoustic channel cone extending from said speaker; and ii. a acoustic channel shell extending from said acoustic channel cone; and iii. two opposed spaced apart sets of external shell threads, each set extending no more than ninety degrees around said acoustic channel shell.

13. The system of claim 12, comprising a tweeter mounted in said acoustic channel shell.

14. The system of claim 12, wherein said diffuser threads are one of engaged and disengaged with said shell threads.

15. The system of claim 12, comprising:

a. a plurality of magnet cups bored into said lower surface;

b. a magnet secured in each said magnet cup of said plurality of magnet cups; and c. a cover plate magnetically secured to said lower surface within said rim via said plurality of said magnets.

16. The system of claim 11, comprising a housing including:

a. a base:

i. supporting said small ceiling speaker; and ii. having an opening through which said acoustic diffuser extends; and b. an enclosure coupled to said base.

17. The system of claim 16, comprising:

a. first and second braces configured to rest on members of a suspended ceiling grid; and b. a first set of first and second extendable rails extending from a first side of said base to support said first brace; and c. a second set of first and second extendable rails extending from an opposing second side of said base to support said second brace.

18. A small ceiling speaker system comprising:

a. an acoustic diffuser having an adjustable length; wherein said acoustic diffuser comprises:

i. a diffuser barrel comprising a cylindrical shell;

ii. two opposed spaced apart sets of internal diffuser threads, each set extending no more than ninety degrees around an internal surface of said diffuser barrel;

iii. a circumferential flange extending radially inward and outward from a lower end of said diffuser barrel; and iv. a plurality of diffuser element supports:

1. extending radially inward from said radially inward extending portion of said flange; and 2. converging on, and of one piece with, an axially central hub;

v. a threaded bore in said hub, and b. said acoustic diffuser having an adjustable acoustic port independent of said adjustable length;

c. a diffuser element, further comprising:

i. a body having a circular circumference;

ii. an upper radially symmetric outwardly descending diffuser surface on said body;

iii. a plurality of radial grooves in said upper radially symmetric outwardly descending diffuser surface, each positioned to receive one diffuser element support of said plurality of diffuser element supports;

iv. a plurality of demarcations on said upper radially symmetric outwardly descending diffuser surface;

v. a flat lower surface on said body;

vi. a plurality of magnet cups bored into said lower surface;

vii. a magnet secured in each said magnet cup of said plurality of magnet cups; and viii. a cover plate magnetically secured to said lower surface within said rim via said plurality of said magnets;

ix. a circumferential rim on said lower surface of said body;

x. a central bore through said body in three diameters configured to receive:

1. a coiled spring 2. a fastener; and 3. a fastener head;

4. a fastener having a head and a threaded portion and sized to extend through and beyond said central bore;

d. a loudspeaker having an acoustic output;

e. an acoustic channel extending from said loudspeaker, wherein said acoustic channel comprises:

i. a acoustic channel cone extending from said speaker; and ii. a acoustic channel shell extending from said acoustic channel cone; and iii. two opposed spaced apart sets of external shell threads, each set extending no more than ninety degrees around said acoustic channel shell;

iv. a tweeter mounted in said acoustic channel shell; and v. wherein said diffuser threads are one of engaged and disengaged with said shell threads.

19. The system of claim 18, comprising a housing including:

a. a base:

i. supporting said small ceiling speaker; and ii. having an opening through which said acoustic diffuser extends; and b. an enclosure coupled to said base;

c. first and second braces configured to rest on members of a suspended ceiling grid; and d. a first set of first and second extendable rails extending from a first side of said base to support said first brace; and e. a second set of first and second extendable rails extending from an opposing second side of said base to support said second brace.

* * * * *